US009795178B2

(12) United States Patent
Suddaby

(10) Patent No.: US 9,795,178 B2
(45) Date of Patent: Oct. 24, 2017

(54) HELMET WITH MULTIPLE PROTECTIVE ZONES

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 857 days.

(21) Appl. No.: 13/841,076

(22) Filed: Mar. 15, 2013

(65) Prior Publication Data

US 2014/0173810 A1 Jun. 26, 2014

Related U.S. Application Data

(63) Continuation-in-part of application No. 13/412,782, filed on Mar. 6, 2012.

(51) Int. Cl.

| | |
|---|---|
| ***A42B 3/00*** | (2006.01) |
| ***A42B 3/12*** | (2006.01) |
| ***A42B 3/06*** | (2006.01) |
| ***A42B 3/32*** | (2006.01) |

(52) U.S. Cl.

CPC ..... *A42B 3/121* (2013.01); *A42B 3/064* (2013.01); *A42B 3/124* (2013.01); *A42B 3/326* (2013.01)

(58) Field of Classification Search

CPC ..... A42B 3/121; A42B 3/064; A42B 3/124; A42B 3/322; A42B 3/326

See application file for complete search history.

(56) References Cited

U.S. PATENT DOCUMENTS

| | | | | |
|---|---|---|---|---|
| 2,064,830 | A * | 12/1936 | Hanson | E05D 15/165 292/15 |
| 2,194,903 | A | 3/1940 | Holstein | |
| 2,374,675 | A * | 5/1945 | Freedman | A42B 3/105 2/6.6 |
| 2,861,272 | A | 11/1958 | Stuart et al. | |
| 3,089,144 | A | 5/1963 | Cherup | |
| 3,107,356 | A | 10/1963 | Pestronk et al. | |
| 3,167,069 | A | 1/1965 | Lobelle | |
| 3,430,458 | A * | 3/1969 | Titt | F16D 1/0835 29/896.91 |
| 3,600,714 | A | 8/1971 | Cade et al. | |
| 3,616,463 | A | 11/1971 | Theodore et al. | |
| 3,668,704 | A | 6/1972 | Conroy et al. | |
| 3,872,511 | A | 3/1975 | Nichols | |
| 3,875,275 | A | 4/1975 | Lemelson | |
| 3,946,441 | A | 3/1976 | Johnson | |
| 4,023,209 | A | 5/1977 | Frieder, Jr. et al. | |

(Continued)

FOREIGN PATENT DOCUMENTS

| | | |
|---|---|---|
| CN | 201094314 | 8/2008 |
| DE | 19544375 | 3/1997 |

(Continued)

*Primary Examiner* — Sally Haden

(74) *Attorney, Agent, or Firm* — Simpson & Simpson, PLLC

(57) ABSTRACT

A protective helmet that includes a hard outer shell including an inner surface, a hard inner shell slidingly connected to the hard outer shell where the hard inner shell is spaced apart from the hard outer shell and a leaf spring comprising a center portion anchored onto the hard inner shell, a first end arranged to slidingly contact the hard outer shell, and a second end arranged to slidingly contact the hard outer shell.

12 Claims, 22 Drawing Sheets

(56) References Cited

U.S. PATENT DOCUMENTS

| | | | | |
|---|---|---|---|---|
| 4,075,717 | A | 2/1978 | Lemelson | |
| 4,124,904 | A * | 11/1978 | Matthes | A42B 3/122 2/413 |
| 4,307,471 | A | 12/1981 | Lovell | |
| 4,586,200 | A | 5/1986 | Poon | |
| 4,903,346 | A | 2/1990 | Reddemann et al. | |
| 5,101,517 | A | 4/1992 | Douglas | |
| 5,181,279 | A | 1/1993 | Ross | |
| 5,204,998 | A | 4/1993 | Liu | |
| 5,263,202 | A | 11/1993 | Siberell | |
| 5,319,808 | A | 6/1994 | Bishop et al. | |
| 5,496,066 | A * | 3/1996 | Hoffmann | B60R 21/02 280/753 |
| 5,815,846 | A | 10/1998 | Calonge | |
| 5,950,244 | A | 9/1999 | Fournier et al. | |
| 5,956,777 | A | 9/1999 | Popovich | |
| 6,138,283 | A | 10/2000 | Kress | |
| 6,378,140 | B1 * | 4/2002 | Abraham | A42B 3/064 2/411 |
| 6,604,246 | B1 | 8/2003 | Obreja | |
| 6,658,671 | B1 | 12/2003 | Von Holst et al. | |
| 6,817,039 | B1 | 11/2004 | Grilliot et al. | |
| 7,774,866 | B2 | 8/2010 | Ferrara | |
| 7,895,681 | B2 | 3/2011 | Ferrara | |
| 8,176,574 | B2 | 5/2012 | Bryant et al. | |
| 2001/0032351 | A1 | 10/2001 | Nakayama et al. | |
| 2008/0229488 | A1 | 9/2008 | Kim | |
| 2010/0000009 | A1 * | 1/2010 | Morgan | A42B 3/124 2/414 |
| 2010/0023135 | A1 * | 1/2010 | Rubie | A61F 2/66 623/55 |
| 2012/0198604 | A1 | 8/2012 | Weber et al. | |
| 2012/0233745 | A1 | 9/2012 | Veazie | |
| 2012/0297526 | A1 | 11/2012 | Leon | |
| 2013/0061371 | A1 | 3/2013 | Phipps et al. | |
| 2013/0167289 | A1 * | 7/2013 | Rensink | A42B 3/127 2/421 |
| 2014/0173810 | A1 | 6/2014 | Suddaby | |
| 2014/0215694 | A1 * | 8/2014 | Grice | A42B 3/06 2/411 |
| 2015/0143617 | A1 * | 5/2015 | Suddaby | A42B 3/124 2/414 |
| 2015/0167768 | A1 * | 6/2015 | Zhao | F16F 1/368 267/164 |
| 2015/0208751 | A1 * | 7/2015 | Day | A42B 3/124 2/414 |
| 2016/0029730 | A1 * | 2/2016 | Day | F16F 3/04 2/412 |
| 2016/0128414 | A1 * | 5/2016 | Gotti | A42B 3/085 2/421 |
| 2016/0157545 | A1 * | 6/2016 | Bowman | A42B 3/14 2/416 |

FOREIGN PATENT DOCUMENTS

| | | |
|---|---|---|
| EP | 0048442 | 3/1982 |
| EP | 1 142 495 | 7/2005 |
| JP | 2001295129 | 10/2001 |
| WO | WO 2010-151631 | 12/2010 |
| WO | 2011090381 | 7/2011 |

* cited by examiner

HELMET WITH MULTIPLE PROTECTIVE ZONES

This application is filed under 35 U.S.C. §120 as a continuation-in-part patent application of U.S. patent application Ser. No. 13/412,782, filed Mar. 6, 2012, which application is incorporated herein by reference in its entirety.

FIELD

The present disclosure relates generally to protective headgear, more particularly to sports or workplace protective headgear, and still more particularly, to protective headgear designed to prevent or reduce head injury caused by linear or rotational forces.

BACKGROUND

The human brain is an exceedingly delicate structure protected by a series of envelopes to shield it from injury. The innermost layer, the pia mater, covers the surface of the brain. Next to the pia mater is the arachnoid layer, a spidery web-like membrane that acts like a waterproof membrane. Finally, the dura mater, a tough leather-like layer, covers the arachnoid layer and adheres to the bones of the skull.

While this structure protects against penetrating trauma because of the bones of the skull, the softer inner layers absorb too little energy before the force is transmitted to the brain itself. Additionally, while the skull may dampen some of the linear force applied to the head, it does nothing to mitigate the effects of angular forces that impart rotational spin to the head. Many surgeons in the field believe the angular or rotational forces applied to the brain are more hazardous than direct linear forces due to the twisting or shear forces they apply to the white matter tracts and the brain stem itself. In addition, when an object strikes a human head, both the object and the human head are moving independently and in different angles thus, angular forces, as well as linear forces, are almost always involved in head injuries.

Mild traumatic brain injury (MTBI), more commonly known as "concussion," is a type of brain injury that occurs frequently in many settings such as construction worksites, manufacturing sites, and athletic endeavors and is particularly problematic in contact sports. While at one time concussion was viewed as a trivial and reversible brain injury, it has become apparent that repetitive concussions, even without loss of consciousness, are serious deleterious events that contribute to debilitating disease processes such as dementia and neuro-degenerative diseases for example, Parkinson's disease, chronic traumatic encephalopathy (CTE), and pugilistic dementias.

U.S. Pat. No. 5,815,846 by Calonge describes a helmet with fluid filled chambers that dissipate force by squeezing fluid into adjacent equalization pockets when external force is applied. In such a scenario, energy is dissipated only through viscous friction as fluid is restrictively transferred from one pocket to another. Energy dissipation in this scenario is inversely proportional to the size of the hole between the full pocket and the empty pocket. That is to say, the smaller the hole, the greater the energy drop. The problem with this design is that, as the size of the hole is decreased and the energy dissipation increases, the time to dissipate the energy also increases. Because fluid filled chambers react hydraulically, energy transfer is in essence instantaneous. Hence, in the Cologne design, substantial energy is transferred to the brain before viscous fluid can be displaced negating a large portion of the protective function provided by the fluid filled chambers. Viscous friction is too slow an energy dissipating modification to adequately mitigate concussive force. If one were to displace water from a squeeze bottle one can get an idea as to the function of time and force required to displace any fluid when the size of the exit hole is varied. The smaller the transit hole, the greater the force required and the longer the time required for any given force to displace fluid.

U.S. Pat. No. 6,658,671 to Holst discloses a helmet with an inner and outer shell with a sliding layer in between. The sliding layer allows for the displacement of the outer shell relative to the inner shell to help dissipate some of the angular force during a collision applied to the helmet. However, the force dissipation is confined to the outer shell of the helmet. In addition, the Holst helmet provides no mechanism to return the two shells to the resting position relative to each other. A similar shortcoming is seen in the helmet disclosed in U.S. Pat. No. 5,956,777 to Popovich and European patent publication EP 0048442 to Kalman, et al.

German Patent DE 19544375 to Zhan discloses a construction helmet that includes apertures in the hard outer shell that allows the expansion of what appears to be a foam inner liner through the apertures to dispel some of the force of a collision. However, because the inner liner appears to rest against the user's head, some force is directed toward rather than away from the head. In addition, there is no mechanism to return the expanded foam liner back to the inside of the helmet.

U.S. Patent Application Publication No. 2012/0198604 to Weber, et al. discloses a safety helmet for protecting the human head against repetitive impacts as well as moderate and severe impacts to reduce the likelihood of brain injury caused by both translational and rotational forces. The helmet includes isolation dampers that act to separate an outer liner from an inner liner. Gaps are provided between the ends of the outer liner and the inner liner to provide space to enable the outer liner to move without contacting the inner liner upon impact. However, it appears that several layers of isolation dampers and outer liners are necessary and no effective protection is provided to protect the brain from direct translational blows.

Clearly, to prevent traumatic brain injury, not only must penetrating objects be stopped, but any force, angular or linear, imparted to the exterior of the helmet must also be prevented from simply being transmitted to the enclosed skull and brain. That is to say that the helmet must not merely play a passive role in dampening such external forces, but must play an active role in dissipating both linear and angular momentum imparted by such forces such that they have little or no deleterious effect on the delicate brain.

To afford maximal protection from linear and angular forces, the skull and the brain must be capable of movement independent of each other, and to have mechanisms which dissipate imparted kinetic energy, regardless of the vector or vectors by which it is applied.

To attain these objectives in a helmet design, the inner component (shell) and the outer component (shell or shells) must be capable of appreciable degrees of movement independent of each other. Additionally, the momentum imparted to the outer shell should both be directed away from and/or around the underlying inner shell and brain and sufficiently dissipated so as to negate deleterious effects.

Another difficulty with protective helmets is the tight fit of the helmet against the user's head. To fit properly, the narrow opening of a conventional helmet must be pulled over the widest part of the user's head. Often the fit is so snug that it can be painful to pull the helmet over the user's head and protruding ears. Consequently, a user may use a larger helmet, which, while more comfortable and easier to put on, does not provide the level of protection obtainable with a correctly fitted helmet.

Clearly, there is a need in the art and science of protective head gear design to mitigate these deleterious consequences of repetitive traumatic brain injury. There is also a need in the field for a helmet that can provide the protection achieved with a proper fit and still be relatively easy to pull over a user's head.

SUMMARY

According to aspects illustrated herein, there is provided a protective helmet that includes a hard outer shell including an inner surface, a hard inner shell slidingly connected to the hard outer shell where the hard inner shell is spaced apart from the hard outer shell and a leaf spring comprising a center portion anchored onto the hard inner shell, a first end arranged to slidingly contact the hard outer shell, and a second end arranged to slidingly contact the hard outer shell.

According to aspects illustrated herein, there is provided a protective helmet including a hard outer shell, a hard inner shell slidingly connected to the outer shell where the inner shell is spaced apart from the outer shell and a leaf spring having a center portion anchored to the hard outer shell, a first end arranged to slidingly contact the hard inner shell, and a second end arranged to slidingly contact the hard inner shell.

According to aspects illustrated herein, there is provided a protective helmet including a hard outer shell, a hard inner shell slidingly connected to the outer shell where the inner shell is spaced apart from the outer shell and an elliptical leaf spring anchored between the hard inner shell and the hard outer shell and arranged to slidingly contact either the hard inner shell or the hard outer shell.

One object is to provide a helmet that directs linear and rotational forces away from the braincase.

A second object is to supply a helmet that includes an outer shell that floats or is suspended above the inner shell.

A third object is to offer a helmet with a sliding connection between the inner and outer shells.

An additional object is to supply a helmet that includes a crumple zone to absorb forces before they reach the braincase of the user.

A further object is to provide a helmet that is comfortable to put on while providing the protection of a helmet with a snug fit.

BRIEF DESCRIPTION OF THE SEVERAL VIEWS OF THE DRAWINGS

The nature and mode of the operation of the various embodiments are described in the following detailed description taken with the accompanying drawing Figures, in which.

DETAILED DESCRIPTION OF EMBODIMENTS

Figure 1:
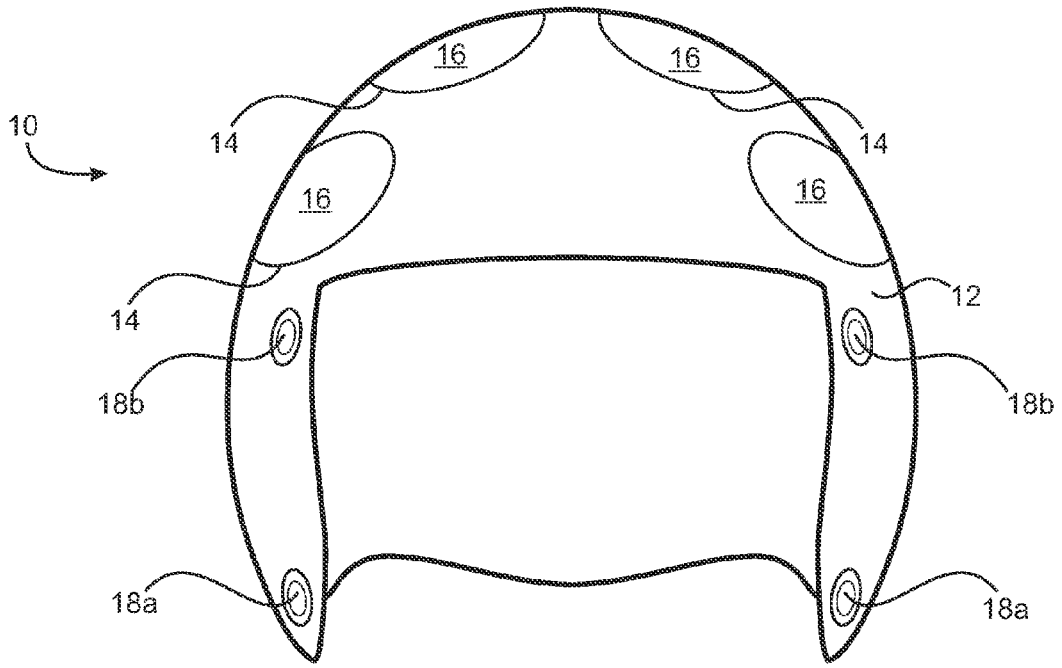
FIG. 1 is a front view of a double shell helmet ("helmet")

At the outset, it should be appreciated that like drawing numbers on different drawing views identify identical structural elements. It also should be appreciated that figure proportions and angles are not always to scale in order to clearly portray the attributes of the various embodiments.

It is understood that this description is not limited to the disclosed embodiments. Various modifications and equivalent arrangements are included within the spirit and scope of the appended claims.

Furthermore, it is understood that this description is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this description pertains. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. Although any methods, devices or materials similar or equivalent to those described herein can be used in the practice or testing of the various embodiments, the preferred methods, devices, and materials are now described. It should be appreciated that the term "proximate" is synonymous with terms such as "nearby", "close", "adjacent", "neighboring", "immediate", "adjoining", etc., and such terms may be used interchangeably as appearing in the specification and claims.

A helmet is presented that includes multiple protective zones formed in layers over the user's skull or braincase. The outer protective zone is formed by an outer shell that "floats" or is suspended on the inner shell such that rotational force applied to the outer shell causes it to rotate, or translate around the inner shell rather than immediately transfer such rotational or translational force to the skull and brain.

The inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like miniature bungee cords that dissipate both angular and linear forces through a mechanism known as hysteretic damping, i.e., when elastomeric cords are deformed, internal friction causes high energy losses to occur. These elastomeric cords are of particular value in preventing so called contrecoup brain injury.

The outer shell, in turn floats on the inner shell by virtue of one or more force absorbers or deflectors such as fluid filled bladders or leaf springs located between the inner shell and the outer shell. To maximize the instantaneous reduction or dissipation of a linear and/or angular force applied to the outer shell, the fluid filled bladders interposed between the hard inner and outer shells may be intimately associated with, that is located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms could be located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid filled helmets fail. The transfer of force is hydraulic and essentially instantaneous, negating the effectiveness of viscous fluid transfers as a means of dissipating concussive force.

Due to the elastomeric diaphragms, any force imparted to the outer shell transfers to the gas or liquid in the bladders, which in turn instantaneously transfers the force to the external elastomeric diaphragms covering the apertures in the outer shell. The elastomeric diaphragms in turn bulge out through the aperture in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low level heat, which in turn is dissipated harmlessly to the surrounding air.

Furthermore, the elastomeric springs or cords that bridge the space holding the fluid filled bladders (like the arachnoid membrane in the brain) serve to stabilize the spatial relationship of the inner and outer shells and provide additional dissipation of concussive force via the same principle of elastic deformation via the mechanism of stretching, torsion and even compression of the elastic cords.

By combining the bridging effects of the elastic springs or cords as well as the elastomeric diaphragms strategically placed at external apertures, both linear and rotational forces can be effectively dissipated.

In an alternate embodiment, leaf springs may replace fluid-filled bladders as a force absorber/deflector. Leaf springs may be structured as a fully elliptical spring or, a parabolic spring. In both forms, the leaf spring is anchored at a single point to either the outer shell or the hard inner shell and extends into the zone between the outer shell and inner shell. The springs may have a single leaf (or arm) or comprise a plurality of arms arrayed radially around a common anchor point. Preferably, each arm tapers from a thicker center to thinner outer portions toward each end of the arm. Further, the ends of each arm may include a curve to allow the end to more easily slide on the shell opposite the anchoring shell. In contrast to the use of leaf springs in vehicles, the distal end of the spring arms are not attached to the nonanchoring or opposite shell. This allows the ends to slide on the shell to allow independent movement of each shell when the helmet is struck by rotational forces. This also enables the frictional dissipation of energy. Preferably, the distal ends contact the opposite shell in the neutral condition, that is, when the helmet is not in the process of being struck.

When elastomeric cords are used in conjunction with leaf springs, the orientation of the cords is similar to their use with the fluid-filled bladders/diaphragm embodiment, but is utilized to absorb rotational forces as the leaf springs handle the liner forces more directly.

Henceforth, elastomeric cords and diaphragms protect against concussion as well as so called coup and contrecoup brain injury and torsional brain injury which can cause sub dural hematoma by tearing bridging veins or injury to the brain stem through twisting of the stem about its central axis.

Figure 2:
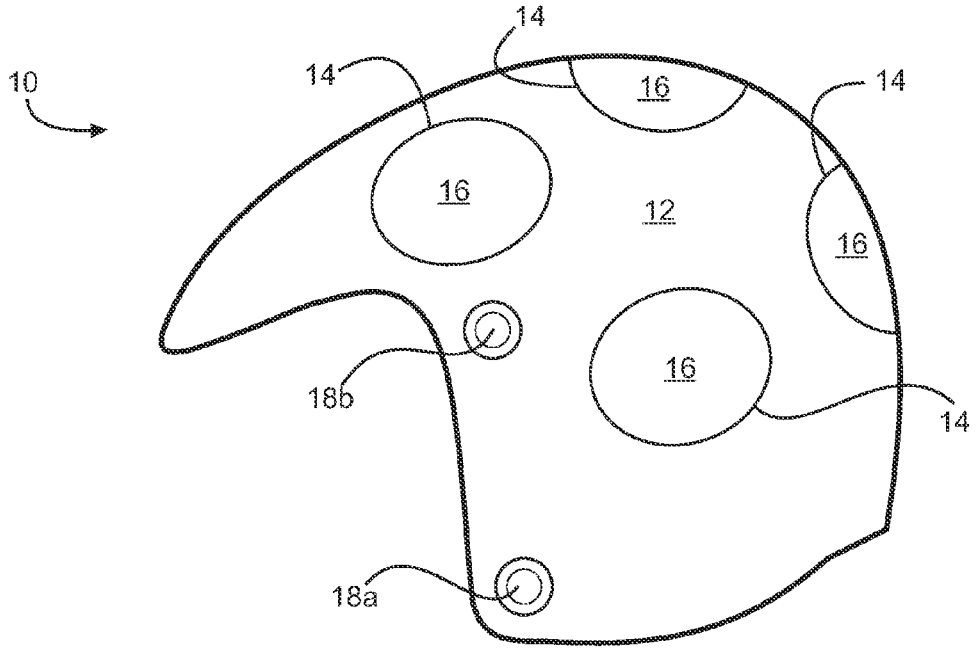
FIG. 2 is a side view of the helmet of FIG. 1 showing two face protection device attachments on one side of the helmet.

Adverting to the drawings, FIG. 1 is a front view of multiple protective zone helmet 10 ("helmet 10"). The outer protective zone is formed by outer shell 12 and is preferably manufactured from rigid, impact resistant materials such as metals, plastics such as polycarbonates, ceramics, composites and similar materials well known to those having skill in the art. Outer shell 12 defines at least one and preferably a plurality of apertures 14. Apertures 14 may be open but are preferably covered by a flexible elastomeric material in the form of diaphragm 16. In an example embodiment, helmet 10 includes several face protection device attachments 18. In an example embodiment, face protection device attachments 18 are fabricated from a flexible elastomeric material to provide flexibility to the attachment. The elastomeric material reduces the rotational pull on helmet 10 if the attached face protection device (not seen in FIG. 1) is pulled. The term "elastomeric" refers to substances resembling rubber in properties, such as resilience and flexibility. Such elastomeric materials are well known to those having ordinary skill in the art. FIG. 2 is a side view of helmet 10 showing two face protection device attachments 18*a* and 18*b* on one side of the helmet. Examples of face protection devices are visors and face masks. Such attachments can also be used for chin straps releasably attached to the helmet in a known manner.

Figure 3A:
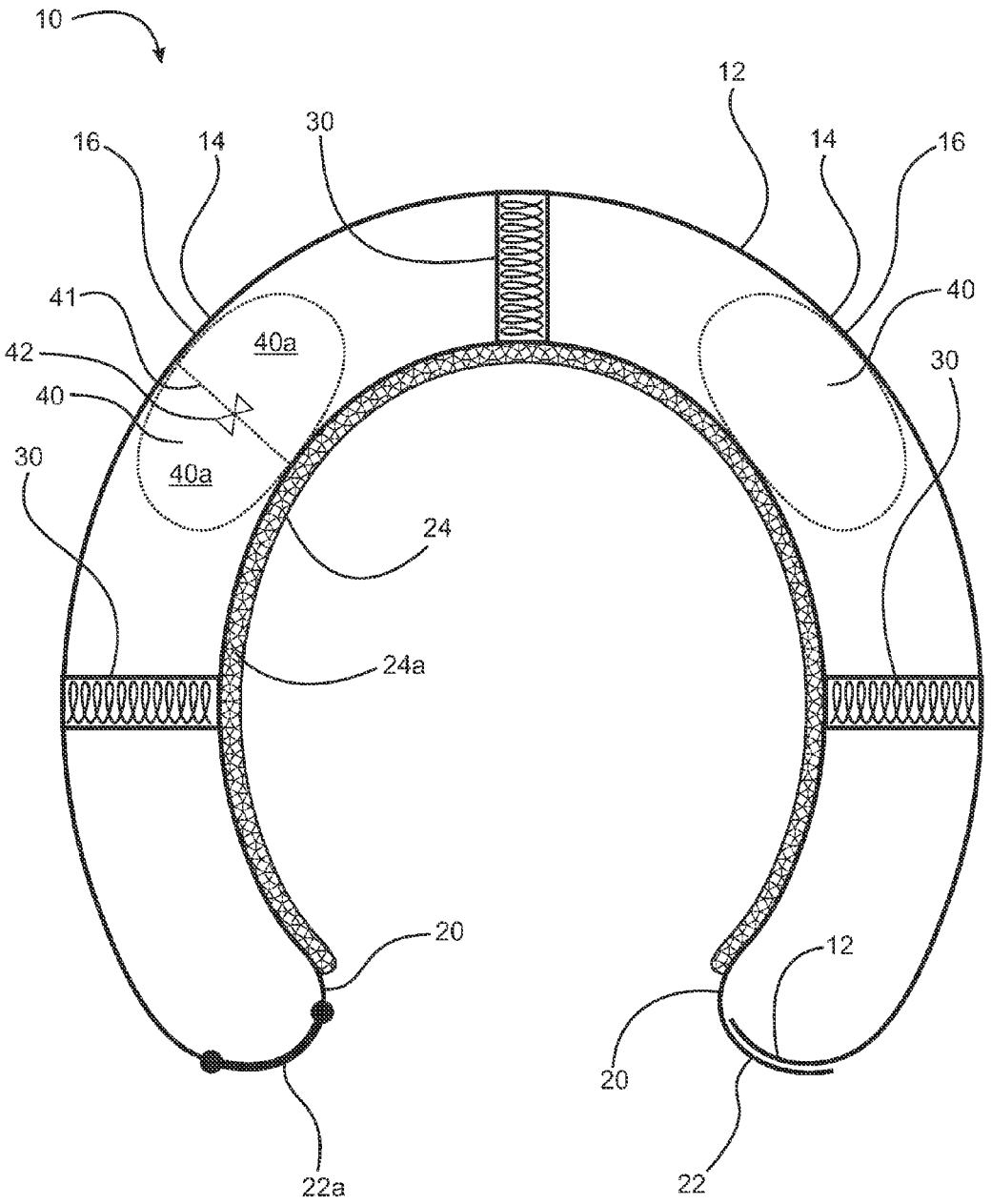
FIG. 3A is a cross-sectional view of the helmet of FIG. 1 showing an inner shell and elastomeric cords connecting the two shells.

FIG. 3A is a cross-sectional view of helmet 10 showing hard inner shell 20 and elastomeric springs or cords 30 ("cords 30") that extend through an elastomeric zone connecting the two shells. Inner shell 20 forms an anchor zone and is preferably manufactured from rigid, impact resistant materials such as metals, plastics such as polycarbonates, ceramics, composites and similar materials well known to those having ordinary skill in the art. Inner shell 20 and outer shell 12 are slidingly connected at sliding connection 22. By slidingly connected, it is meant that the edges of inner shell 20 and outer shell 12, respectively, slide against or over each other at connection 22. In an alternate embodiment, outer shell 12 and inner shell 20 are connected by an elastomeric element, for example, a u-shaped elastomeric connector 22*a* ("connector 22*a*"). Sliding connection 22 and connector 22*a* each serve to both dissipate energy and maintain the spatial relationship between outer shell 12 and inner shell 20.

Cords 30 are flexible cords, such as bungee cords or elastic "hold down" cords or their equivalents used to hold articles on car or bike carriers. This flexibility allows outer shell 12 to move or "float" relative to inner shell 20 and still remain connected to inner shell 20. This floating capability is also enabled by sliding connection 22 between outer shell 12 and inner shell 20. In an alternate embodiment, sliding connection 22 may also include an elastomeric connection 22*a* between outer shell 12 and inner shell 20. Padding 24 forms an inner zone and lines the inner surface of inner shell 20 to provide a comfortable material to support helmet 10 on the user's head. In one embodiment, padding 24 may enclose loose cushioning pieces such as STYROFOAM® beads 24*a* or "peanuts" or loose oatmeal.

Also seen in FIG. 3A is a cross-sectional view of bladders 40 situated in the elastomeric zone between outer shell 12 and inner shell 20. Helmet 10 includes at least one and preferably a plurality of bladders 40. Bladders 40 are filled with fluid, either a liquid such as water or a gas such as helium or air. In one embodiment, the fluid is helium as it is light and its use reduces the total weight of helmet 10. In an alternate embodiment, bladders 40 may also include compressible beads or pieces such as STYROFOAM® beads. Bladders 40 are preferably located under apertures 14 of outer shell 12 and are in contact with both inner shell 20 and outer shell 12. Thus, if outer shell 12 is pressed in toward inner shell 20 and the user's skull during a collision, the fluid in one or more of bladders 40 compresses and squeezes bladder 40, similar to squeezing a balloon. Bladder 40 bulges toward aperture 14 and displaces elastomeric diaphragm 16. This bulging-displacement action diverts the force of the blow from the user's skull and brain up toward the aperture providing a new direction for the force vector. Bladders 40 may also be divided internally into compartments 40*a* by bladder wall 41 such that if the integrity of one compartment is breached, the other compartment still functions to dissipate linear and rotational forces. Valve(s) 42 may also be included between the compartments to control the fluid movement.

Figure 3B:
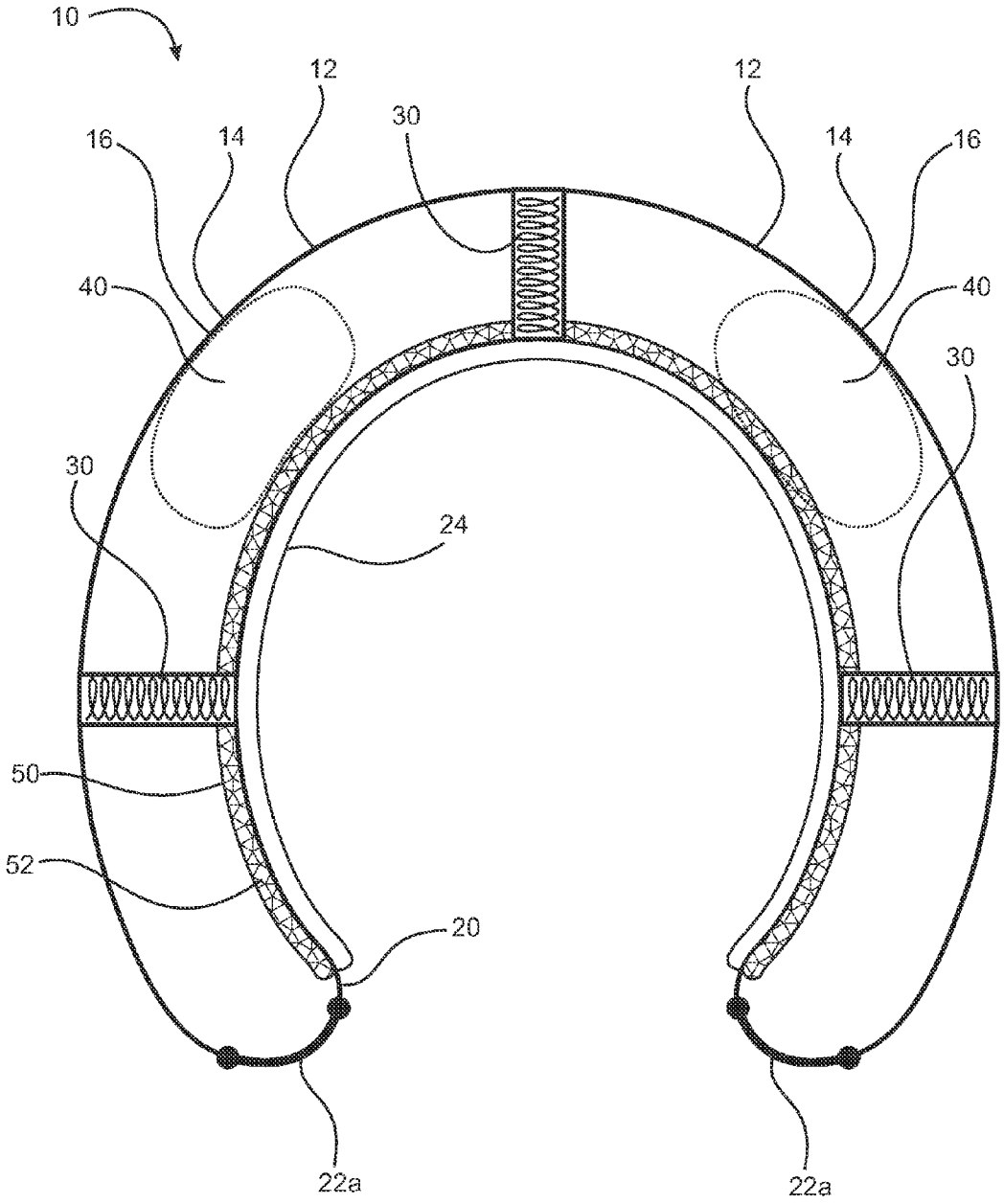
FIG. 3B is a cross-sectional view similar to FIG. 3 depicting an alternate embodiment of the helmet including an intermediate shell enclosing cushioning pieces.

FIG. 3B is a cross-sectional view similar to FIG. 3 discussed above depicting an alternate embodiment of helmet 10. Helmet 10 in FIG. 3B includes a crumple zone formed by intermediate shell 50 located between outer shell 12 and inner shell 20. In the embodiment shown, intermediate shell 50 is close to or adjacent to inner shell 20. As seen in FIG. 3B, intermediate shell 50 encloses filler 52. Preferably, filler 52 is a compressible material that is packed to deflect the energy of a blow to protect the skull, similar to a "crumple zone" in a car. The filler is designed to crumple or deform, thereby absorbing the force of the collision before it reaches inner pad 24 and the brain case. In this embodiment, it can be seen that cords 30 extend from inner shell 20 to outer shell 12 through intermediate shell 50. One suitable filler 52 is STYROFOAM® beads or "peanuts" or an equivalent material such as those materials used in packing objects. Because of its "crumpling" function, intermediate shell 50 is preferably constructed with a softer or more deformable materials than outer shell 12 or inner shell 20. Typical fabrication material for intermediate shell 50 is a stretchable material such as latex or spandex or other similar elastomeric fabric that preferably encloses filler 52.

Figure 3C:
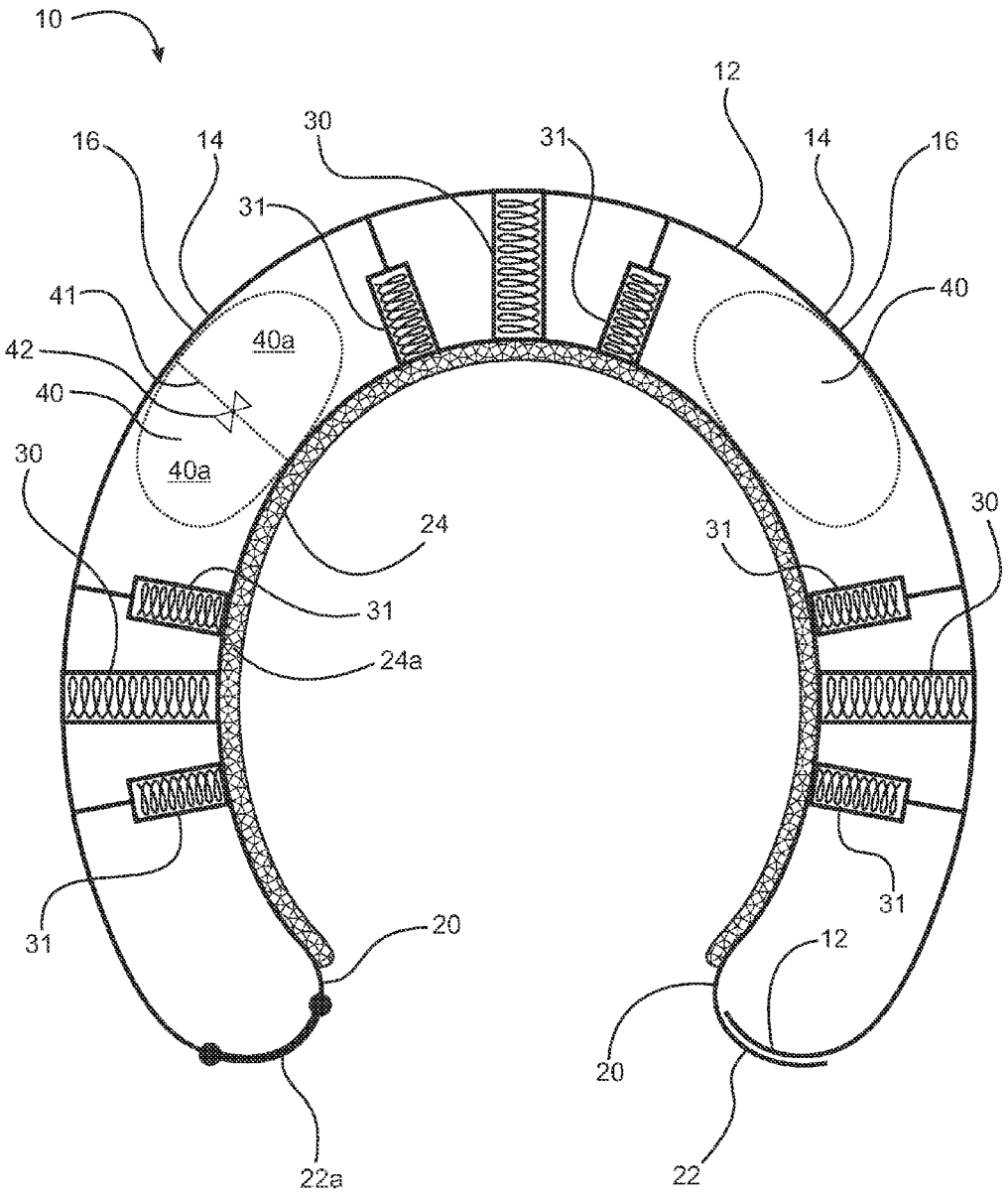
FIG. 3C is a cross-sectional view similar to FIG. 3A depicting an alternate embodiment of the elastomeric cords in which some of the elastomeric cords have thin and thick portions.

FIG. 3C is a cross-sectional view similar to FIG. 3A depicting an alternate embodiment of helmet 10 in which elastomeric cords 31 ("cords" 31) have thin and thick portions. In the embodiment shown, the thick elastomeric portions may be anchored on either the inner surface of outer shell 12 or outer surface of inner shell 20. Similarly, the thin nonelastomeric portions of cords 31 may be attached to either the inner surface of outer shell 12 or the outer surface of inner shell 20. The thin elastomeric portions may be a single or multiple cords.

Figure 4:
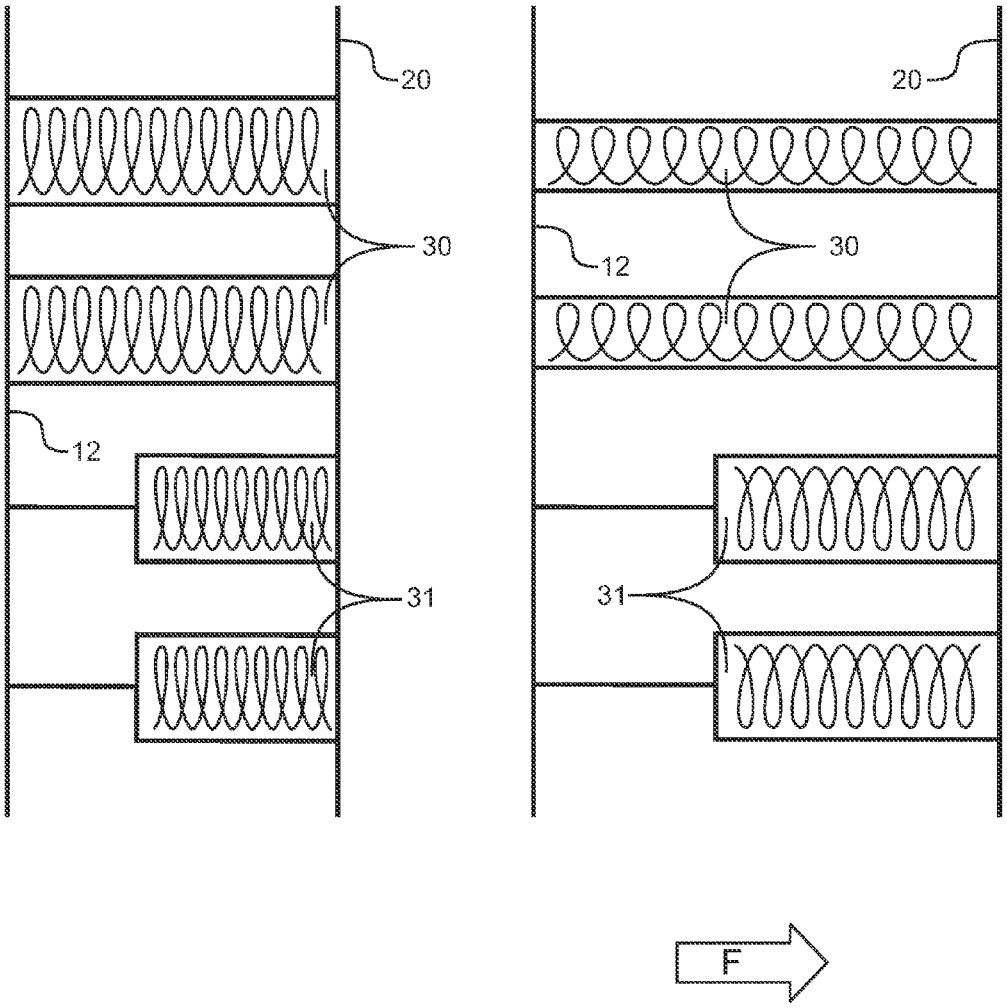
FIG. 4 is a schematic view of both types of cords in both a neutral position and in maximal deployment when the helmet is hit with greater than normal force.

FIG. 4 is a schematic view of cords 31 in a neutral position and in maximal deployment when helmet 10 is hit with greater than normal force. Cords 30 have uniform thickness throughout their lengths. In the neutral position on the left of FIG. 4, cords 30 are under slight tension while cords 31 are under not tension. On the right of FIG. 4, under maximal displacement of outer shell 12 relative to inner shell 20, cords 30 may be stretched close or up to its elastic limit, but the thin portion of cord 31 engages the thicker portion to mitigate the large force striking helmet 10 and prevent any loss of elasticity in cord 30. By using cord 31 as a backup for blows struck with severe force, greater protection can be achieved even after cord 30 reaches its elastic limit and does not interfere with absorbing any rotational force striking helmet 10. For this reason, cord(s) 31 preserve the integrity of the cord system of helmet 10.

Figure 5A:
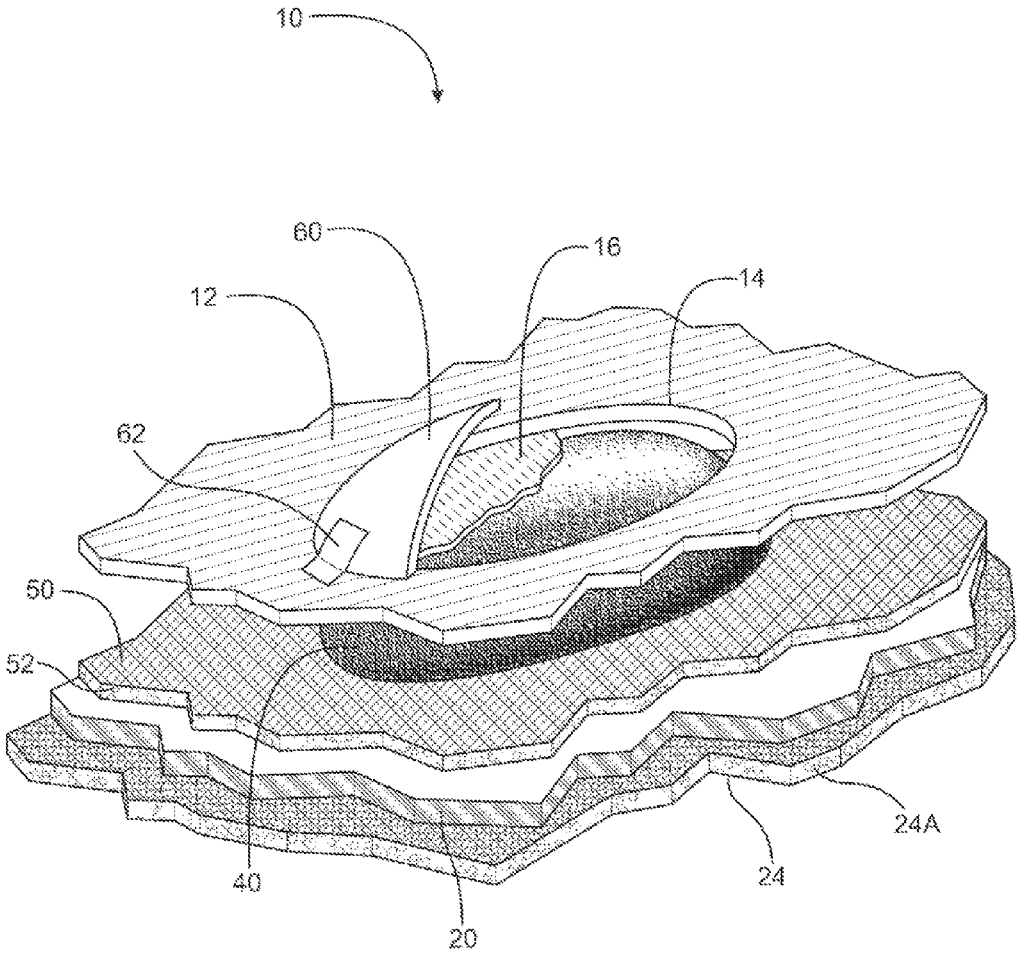
FIG. 5A is a top perspective view of a section of the outer shell of the helmet showing an alternate embodiment including a liftable lid that protect diaphragms covering apertures in the outer shell of the helmet.
Figure 5B:
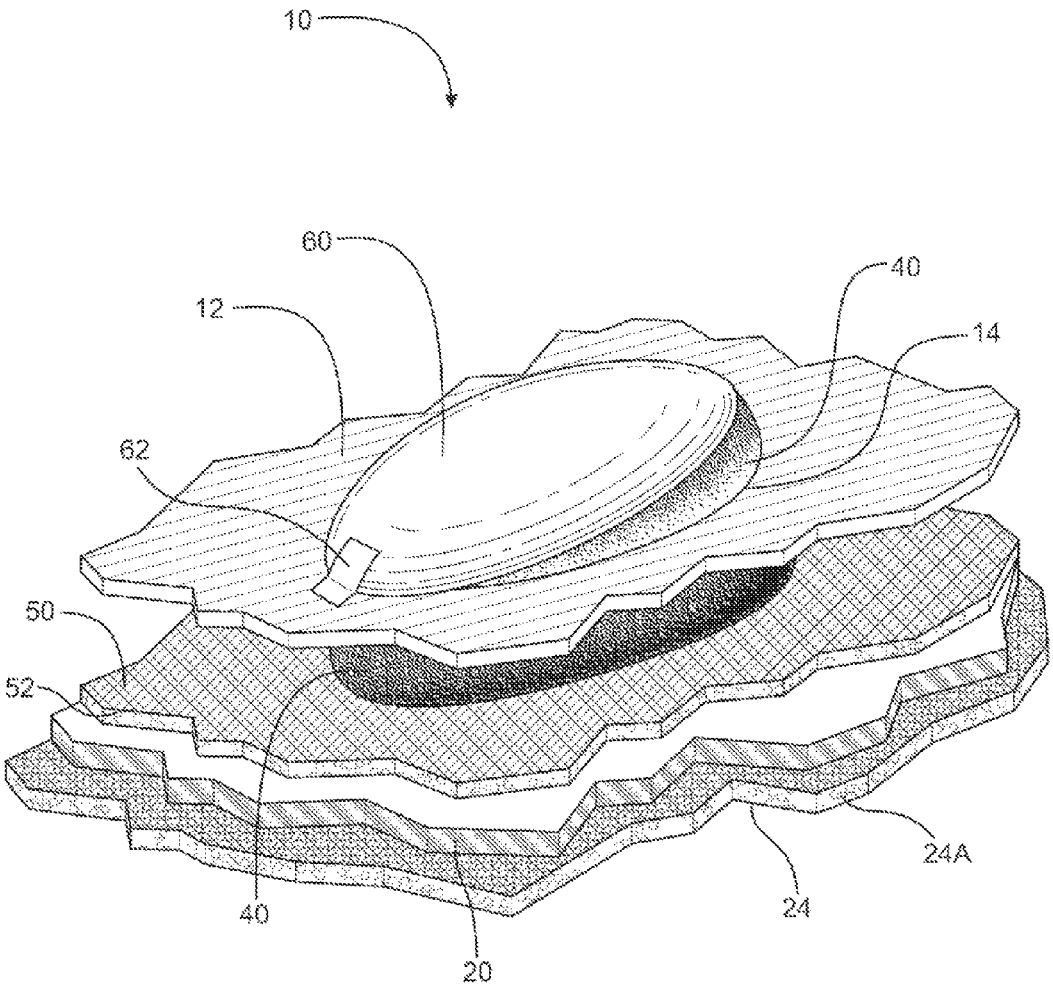
FIG. 5B is a the same view as FIG. 5A depicting the liftable lid protecting the bulging fluid-filled bladder.

FIG. 5A is a top view of one section of outer shell 12 of helmet 10 showing an alternate embodiment in which liftable lids 60 ("lid 60") are used to cover aperture 14 to shield diaphragm 16 and/or bladder 40 from punctures, rips, or similar incidents that may destroy their integrity. Lids 60 are attached to outer shell 12 by lid connector 62 ("connector 62") in such a way that they lift or raise up if a particular diaphragm 16 bulges outside of aperture 14 due to the expansion of one or more bladders 40, exposing it to additional collisions. Because it is liftable, lid 60 allows diaphragm 16 to freely elastically bulge through aperture 14 above the surface of outer shell 12 to absorb the force of a collision, but still be protected from damage caused by external forces. In an alternate embodiment, diaphragm 16 is not used and lid 60 directly shields and protects bladder 40. In one embodiment, lids 60 are attached to outer shell 12 using hinges 62. In an alternate embodiment, lids 60 are attached using flexible plastic attachment 62. FIG. 5B depicts liftable lid 60 protecting bladder 40 as it bulges above outer shell 12.

Figure 6A:
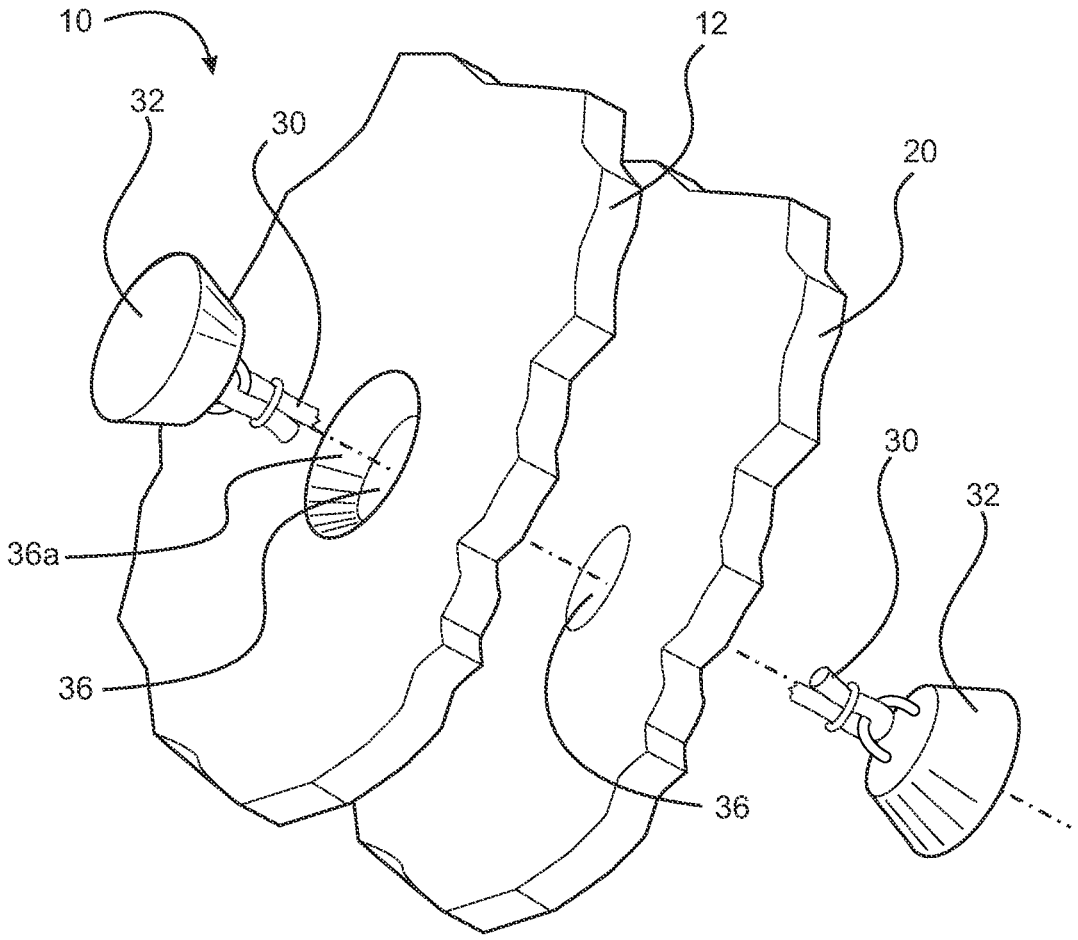
FIG. 6A is an exploded view showing the attachment of the cord to both the inner shell and outer shell to enable the outer shell to float around the inner shell.

FIG. 6A is an exploded view showing one method cord 30 is attached to helmet 10 to enable outer shell 12 to float over inner shell 20. Cavities 36, preferably with concave sides 36*a*, are drilled or otherwise placed in outer shell 12 and inner shell 20 so that the holes are aligned. Each end of cord 30 is attached to plugs 32 which are then placed in the aligned holes. In one embodiment, plugs 32 are held in cavities 36 using suitable adhesives known to those having ordinary skill in the art. In an alternate embodiment, plugs 32 are held in cavities 36 with a friction fit or a snap fit.

Figure 6B:
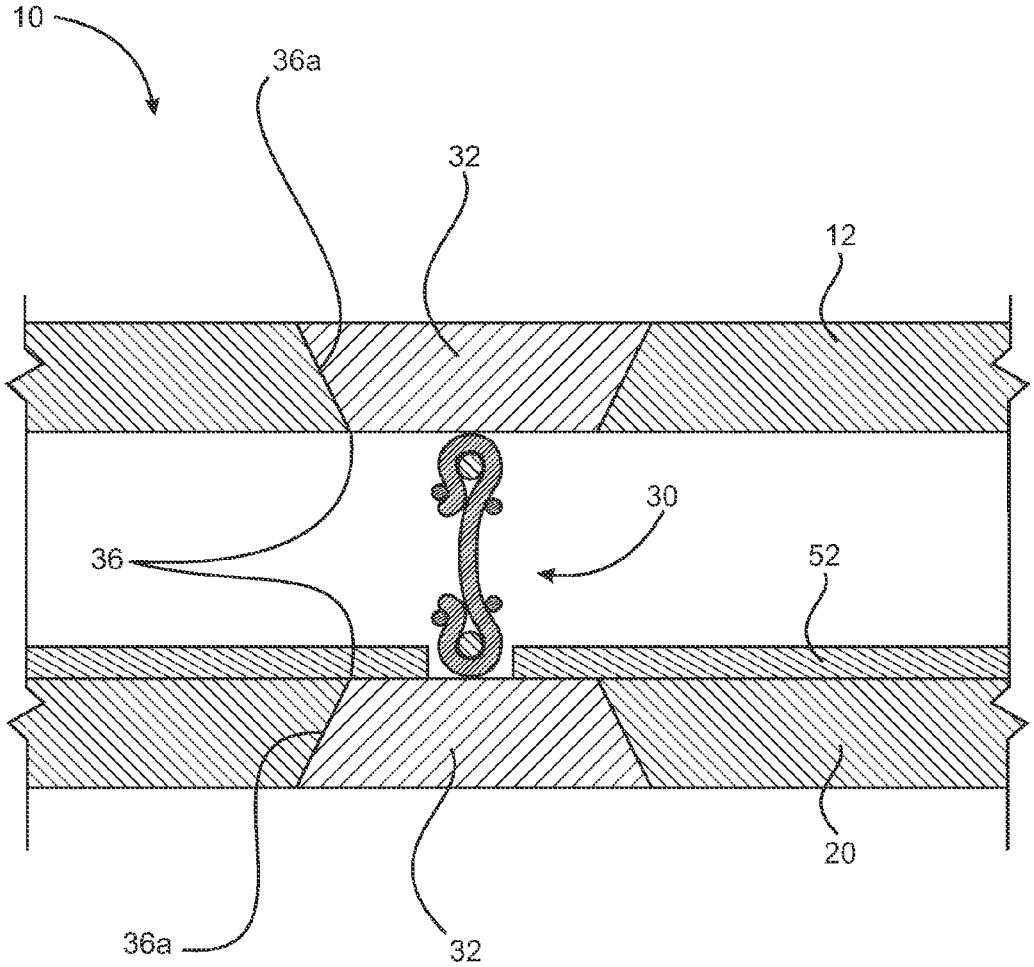
FIG. 6B is a cross-sectional view of the completed attachment fitting with the elastomeric cord attached to two plugs and extending between the outer shell and the inner shell of the helmet.

FIG. 6B is a cross-sectional view of a completed fitting in which cord 30 is attached to two plugs 32 and extends between outer shell 12 and inner shell 20. Intermediate shell 50 encloses filler 52. Bladders 40 are situated between intermediate shell 50 (or inner shell 20) and outer shell 12 although not visible in FIG. 6B. Persons having ordinary skill in the art recognize that cords 31 may be attached between outer shell 12 and inner shell 20 in a similar manner.

Figure 7:
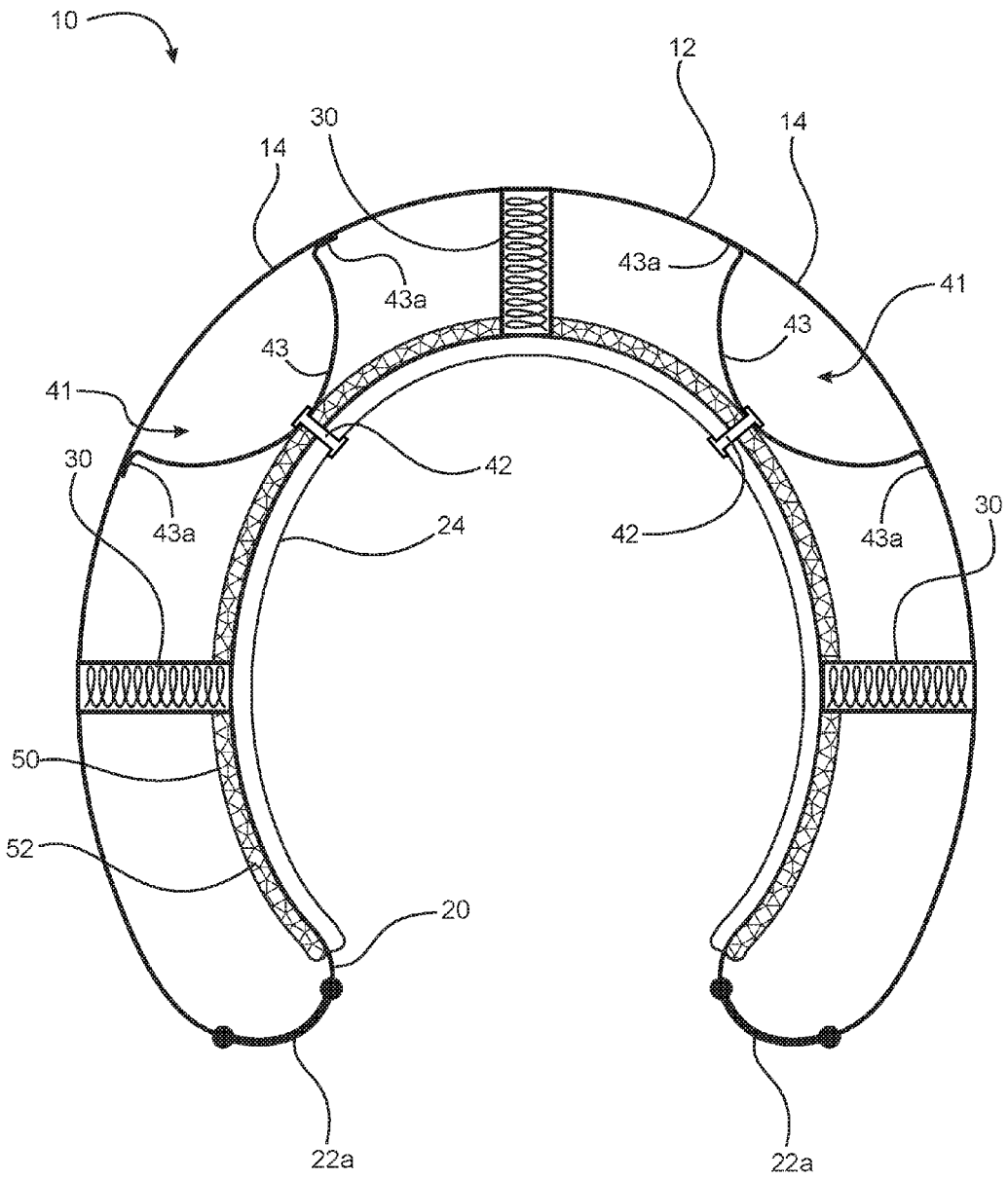
FIG. 7 is a cross-sectional view of an alternate embodiment of the helmet including parabolic leaf springs.
Figure 7A:
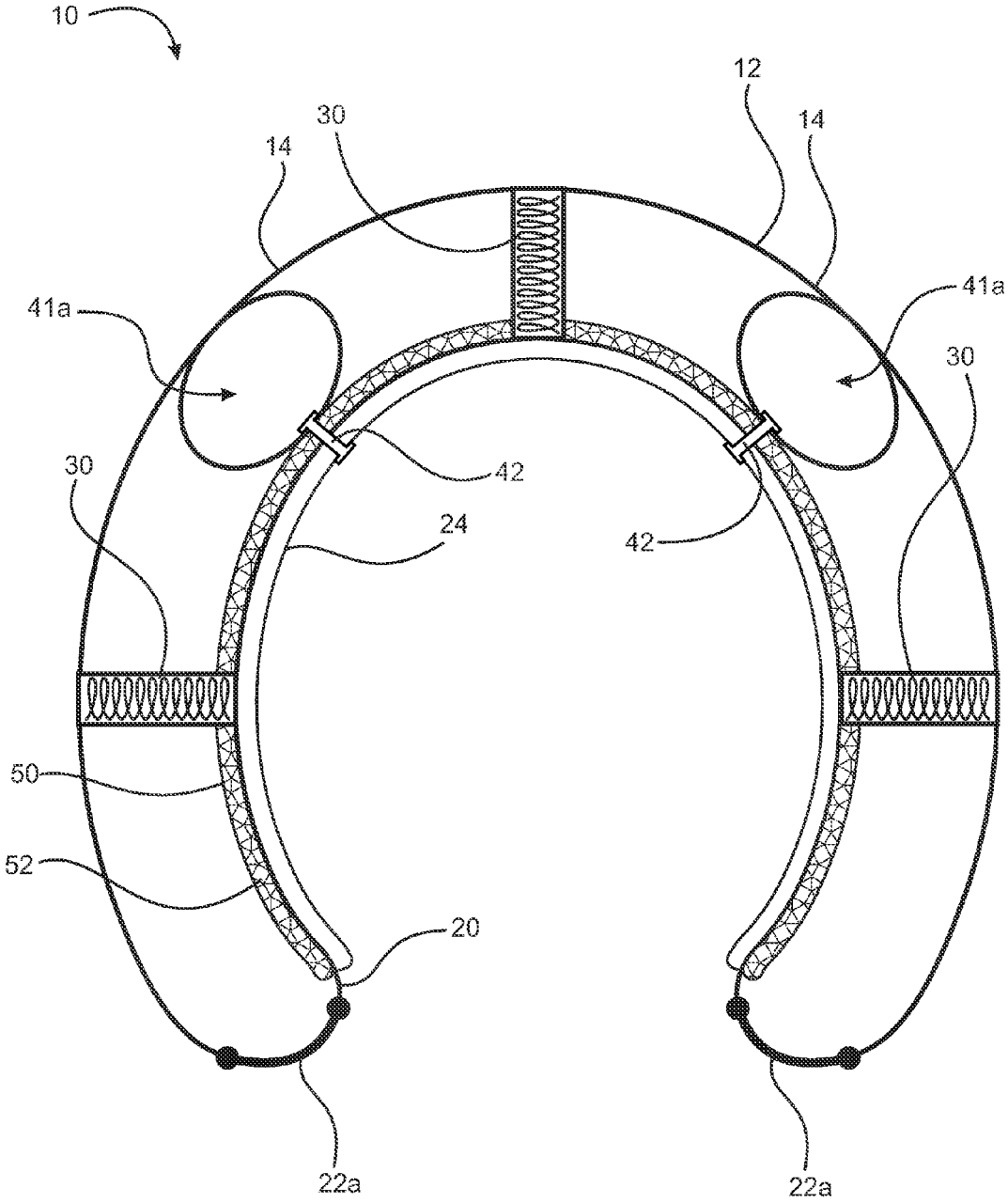
FIG. 7A is a cross-sectional view of an alternate embodiment of the helmet including elliptical leaf springs.

FIG. 7 is a cross-sectional view of an alternate embodiment of helmet 10 in which bladders 40 are replaced as force absorbers/deflectors with parabolic leaf springs 41 ("springs 41"). In the embodiment shown, springs 41 are anchored onto inner shell 20 at anchor point 42. Springs 41 include at least one arm 43 with two ends 43*a* which are preferably shaped into a curve as shown. Arms 43 are preferably tapered having a thicker center portion near anchor point 42 and gradually thinning in width and/or thickness towards ends 43*a*. In addition, arms 43 may be laminated with gradually more elastic layers applied more distally from anchor point 42. A plurality of arms 43 may be arrayed radially around and attached to a single anchor point 42. As shown in FIG. 7, arms 43 extend through crumple zone 50, if present. Leaf springs 41 may also be used with elastomeric cords 30. FIG. 7A is an alternate embodiment in which elliptical leaf springs 41*a* ("springs 41*a*"), also attached at a single anchor point 42, are used in place of parabolic leaf springs 41.

Figure 8:
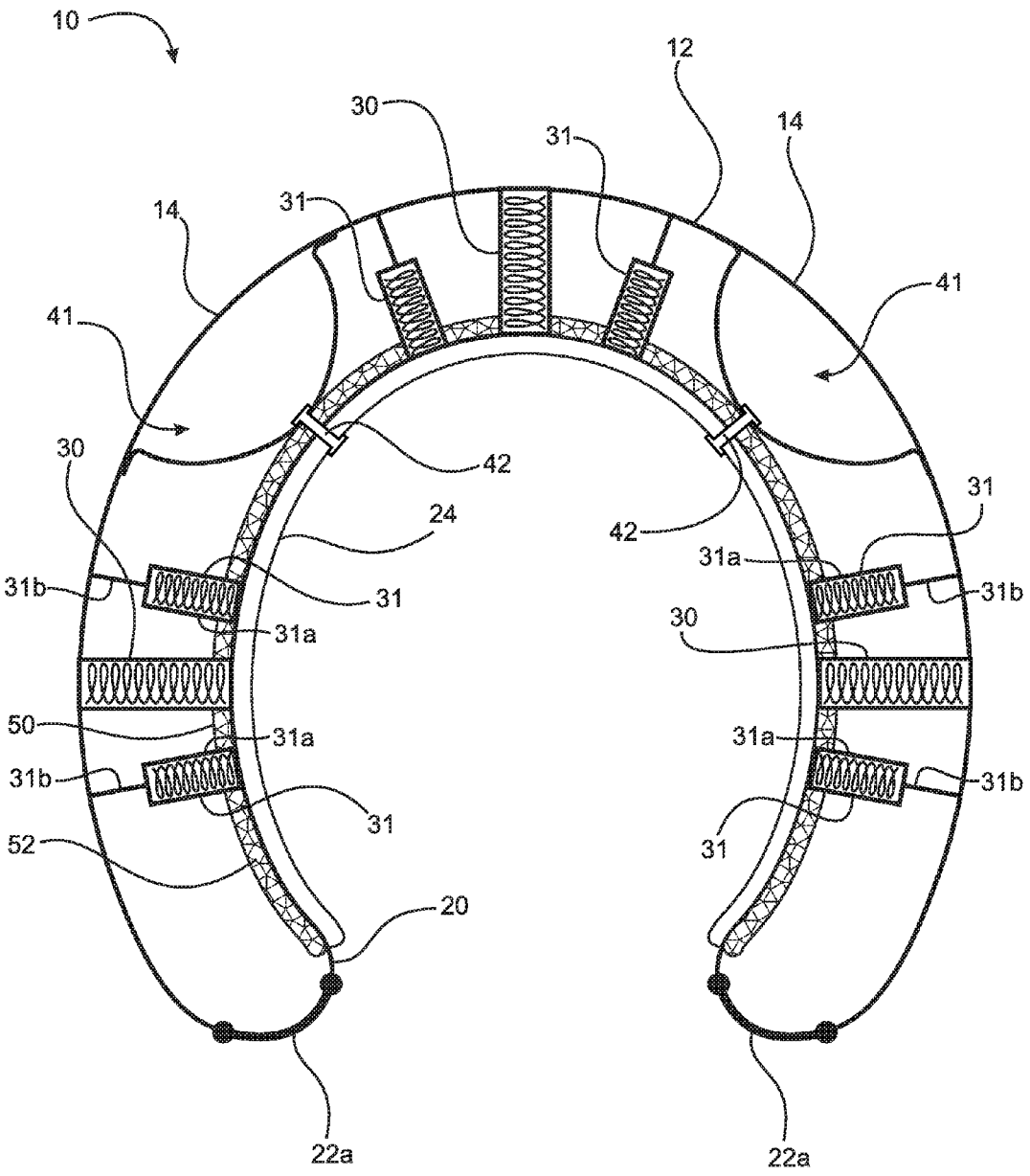
FIG. 8 is a cross-sectional view of the alternate embodiment of the protective helmet shown in FIG. 7 showing the leaf springs with elastomeric cords.

FIG. 8 is a cross-sectional view of an alternate embodiment of helmet 10 shown in FIG. 7 showing leaf springs 41 with elastomeric cords 30 and cords 31. As described above, cords 31, whose thick portions 31*a* are thicker than uniform cords 30, act as a backup to prevent cords 30 from being stretched beyond their elastic limit. As shown in FIG. 8, thick portions 31*a* may be attached to either outer shell 12 or inner shell 20. Cords 31 also include thin portions 31*b*, which may be attached to either outer shell 12 or inner shell 20.

Figure 9:
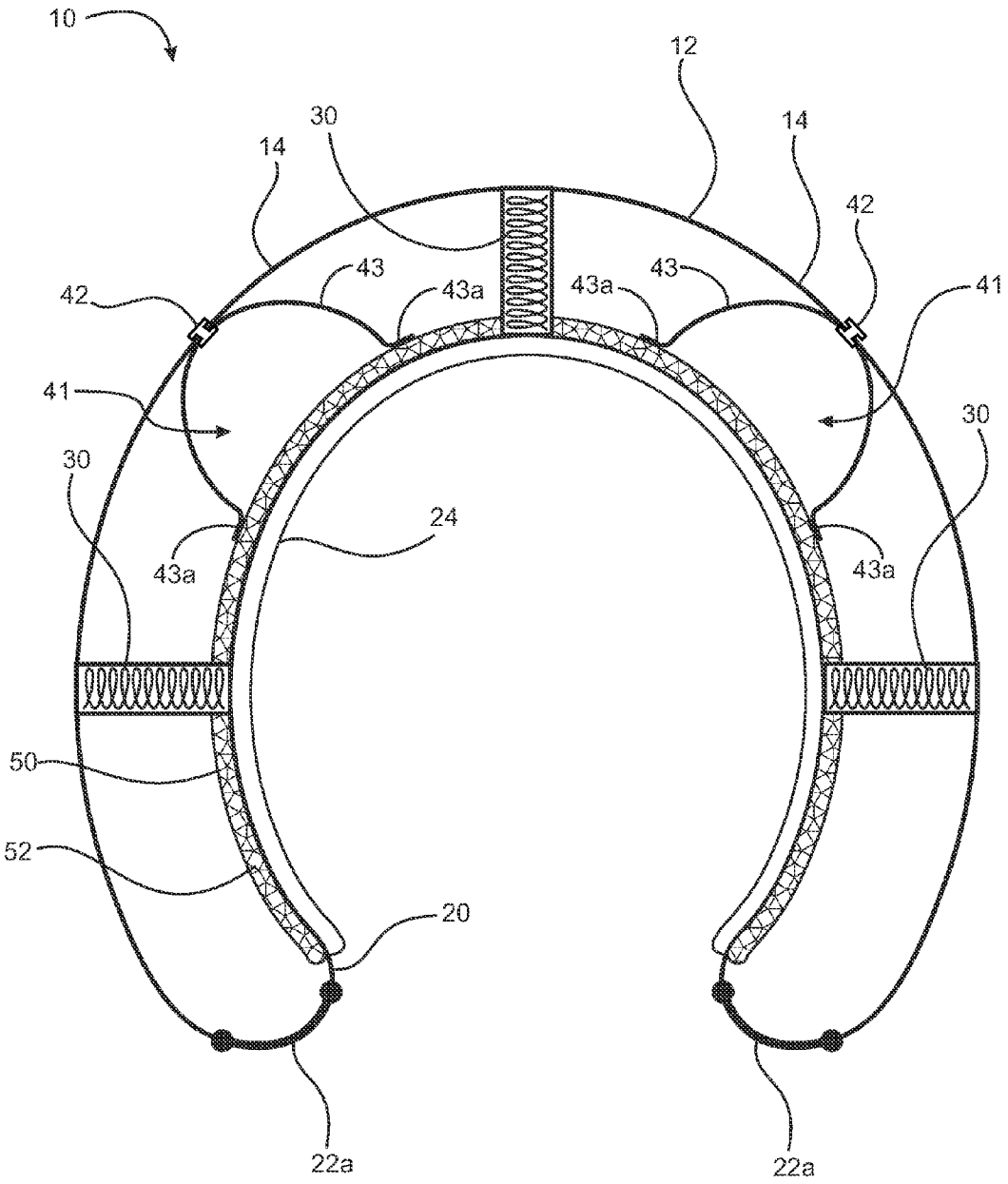
FIG. 9 is a cross-sectional view of the helmet illustrating leaf springs anchored on the outer shell of the helmet.

FIG. 9 is a cross-sectional view of helmet 10 illustrating leaf springs 41 anchored on outer shell 12 with cords 30. It is understood that cords 31 may also be used with this embodiment.

Figure 10A:
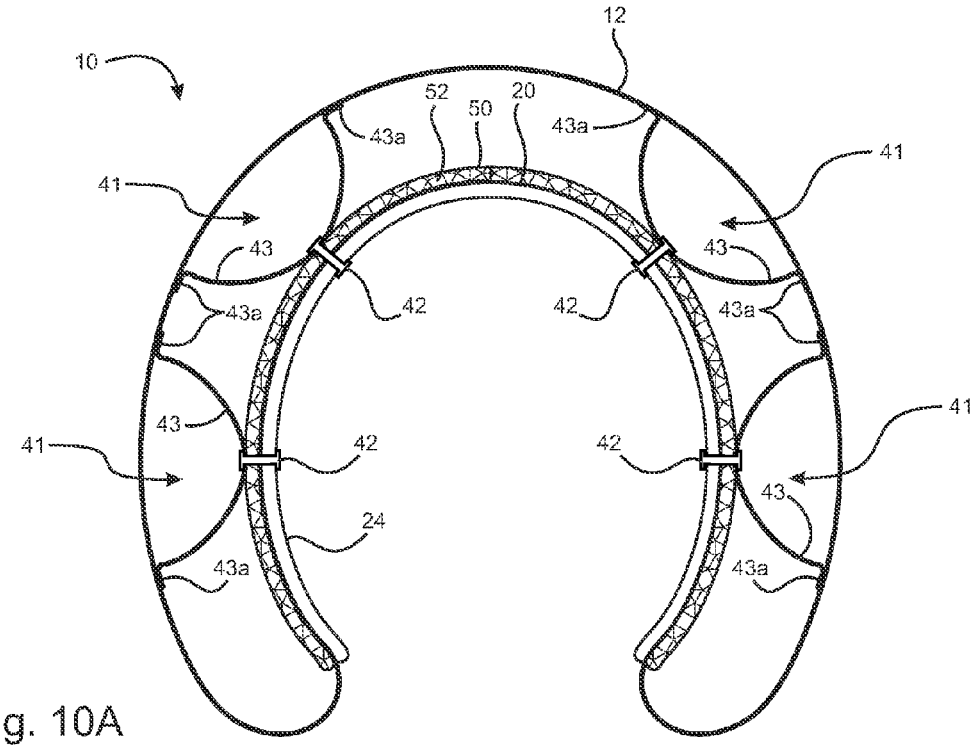
FIG. 10A depicts schematically the parabolic leaf springs when the helmet is in a neutral state before being struck by a force.
Figure 10B:
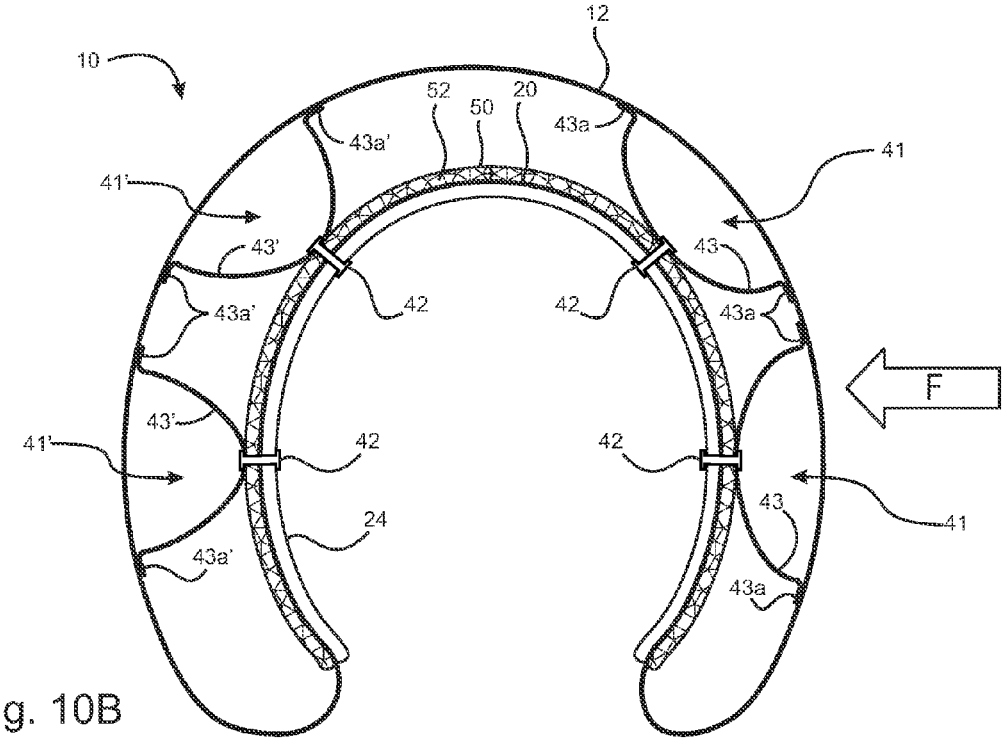
FIG. 10B depicts schematically how the parabolic leaf springs temporarily change their shape when absorbing a force striking the helmet.

FIGS. 10A and 10B depict schematically the action of leaf springs 41 when helmet is struck by a force. In FIG. 10A, helmet 10 is in the neutral state. Springs 41 are shown in relatively slight tension on all sides of helmet 10. In FIG. 10B, force F strikes helmet 10 from the right hand side. Ends 43*a* are separated further from each other as arms 43 are pushed toward inner shell 20 to absorb the translational force vector created by force F. Simultaneously, ends 43*a*' of arms 43' of the springs 41' located on the opposite side of helmet 10 move closer together as the tension on arms 43' is reduced as the left side of outer shell 12 is temporarily moved away from inner shell 20. After force F is exhausted, the increased tension created on the arms 43 on the right hand or contact side of helmet 10 act to push outer shell 12 toward the neutral position. This is aided by the relaxed tension of arms 43' on the noncontact side of helmet 10 which enables that side of outer shell 12 to move into the neutral position closer to inner shell 20. Although not shown in FIGS. 10A and 10B, it should be understood that cords 30 and/or cords 31 act to absorb any rotational force generated on helmet 10 by force F.

Figure 11:
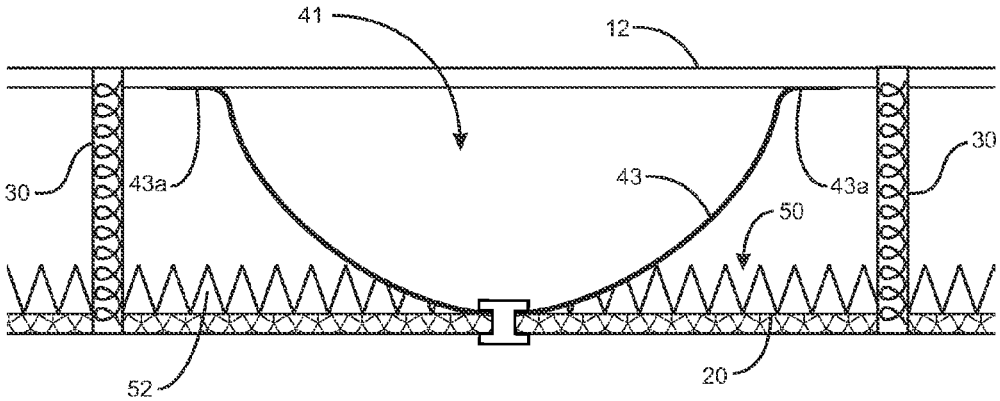
FIG. 11 is an enlarged schematic cross-sectional view of a crumple zone in a helmet in which a leaf spring is the force absorber/deflector.
Figure 12:
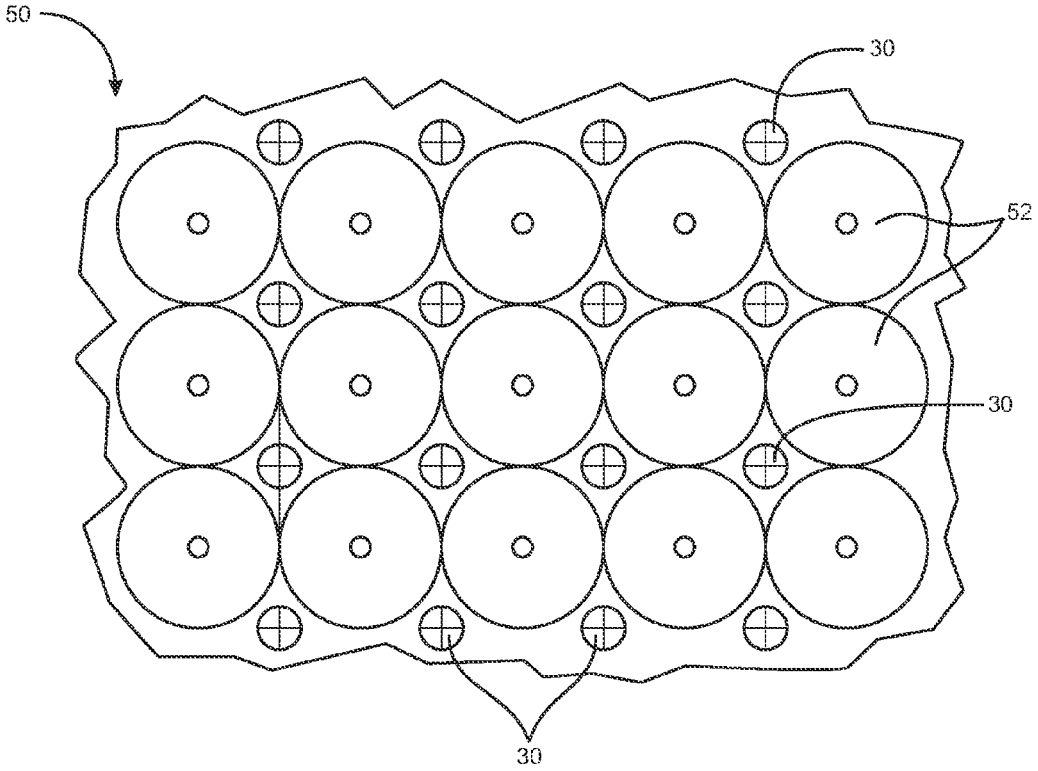
FIG. 12 is a top view of the crumple zone showing a plurality of elastomeric cords extending between the cones of a visco-elastic material.

FIG. 11 is an enlarged schematic cross-sectional view of crumple zone 50 in helmet 10 in which leaf spring 41 is the force absorber/deflector. Elastomeric cords 30 extend from inner shell 20 to outer shell 12. Crumple zone 50 is between cords 30 and preferably includes SORBOTHANE® brand visco-elastic polymer or other visco-elastic materials 52. In the embodiment shown, the visco-elastic material is in the shape of cones. Visco-elastic materials provide the advantage of behaving like a quasi-liquid, being readily deformed by an applied force and slow to recover, although in the absence of such a force it takes up a defined shape and volume. An unusually high amount of the energy from an object dropped onto SORBOTHANE® brand visco-elastic material is absorbed. Leaf spring 41 is anchored to inner shell 20 and extends up through crumple zone 50 and contacts outer shell 12. In this embodiment, cones 52 in crumple zone 50 act to absorb a blow having much greater than normal force so that springs 41 are deflected to such a degree that outer shell reaches crumple zone 50. FIG. 12 is a top view of crumple zone 50 showing a plurality of cords 30 extending between cones 52 of the visco-elastic material. It is understood that helmet 10 employing fluid-filled bladders 40 may include crumple zone 50 having visco-elastic materials 52.

Figure 13A:
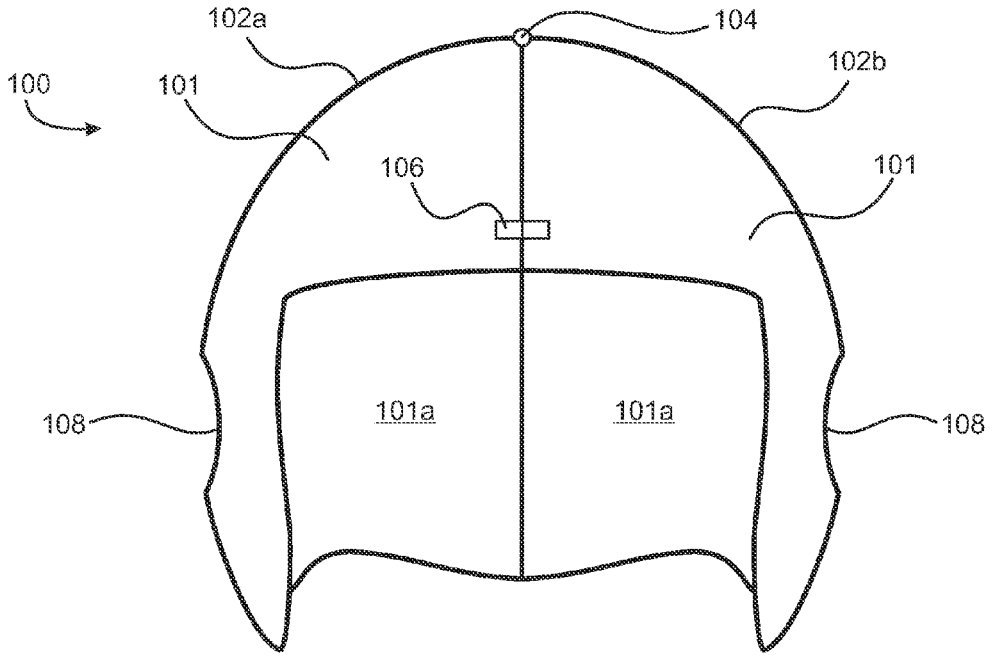
FIG. 13A is a front view of an articulating helmet which is divided into at least two parts which are attached by an articulating means such as hinges or pivots.
Figure 13B:
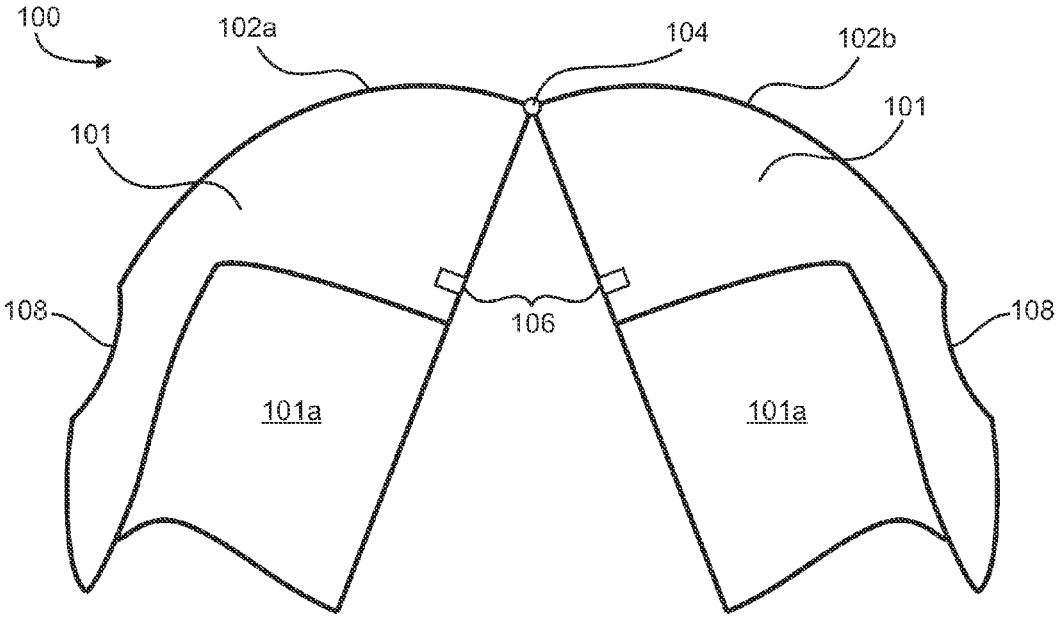
FIG. 13B is a front view of an articulating helmet which is divided into two parts.

FIGS. 13A and 13B are front views of articulating helmet 100 ("helmet 100") which is divided into at least two parts that are attached by an articulating means. By articulating is meant a helmet possesses parts or sections joined by an articulating means such as hinge or pivot connections, swivels, or other devices that can allow separate parts of a helmet to be opened and closed together. Each section includes hard outer shell 101.

FIG. 13A shows helmet 100 in the closed and locked orientation. Sections 102*a* and 102*b* are joined by articulating means 104. In this embodiment, articulating means 104 is hinge 104. It will be recognized that more than one hinge 104 or other articulating means may be used to open and close helmet 100. Preferably, helmet 100 includes at least one lock 106 to hold helmet 100 in the closed position. Ear apertures 108 are also shown along with inner surface 103.

FIG. 13B shows helmet 100 in the open orientation. Lock 106 is unlocked allowing hinge 104 to open separating sections 102*a* and 102*b*.

Figure 14A:
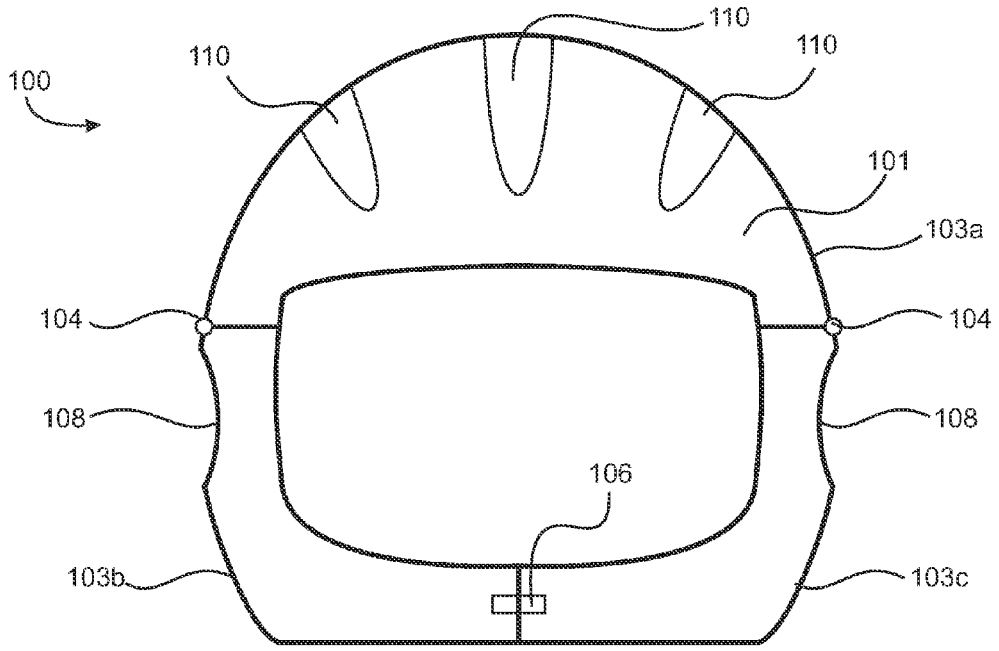
FIG. 14A is a front view of an alternate embodiment of the articulating helmet having three articulating sections.
Figure 14B:
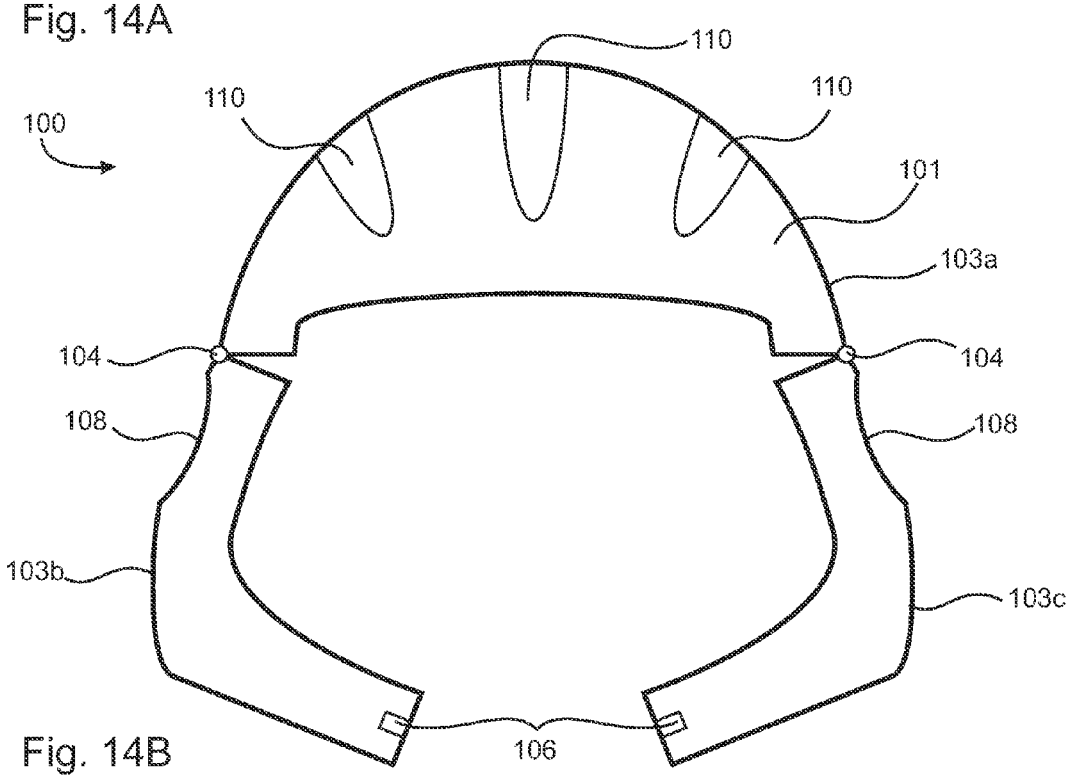
FIG. 14B is a front view of the articulating helmet of FIG. 14A.

FIGS. 14A and 14B depict front views of an alternate embodiment of helmet 100 having three sections 103*a*, 103*b*, and 103*c*. In this embodiment, helmet 100 also includes air vents 110 which are openings extending from outer surface 101 through to inner surface 103 of helmet 100 and defined by helmet 100. Hinges 104 pivot to move sections 103*b* and 103*c* closed with section 103*a*. One or more locks 106 hold the sections in the closed position. It should be recognized that air vents 110 may be present in helmets with two or more than three sections such as shown in FIGS. 13A and 13B. FIG. 13B shows helmet 100 in the open position in which both hinges 104 open to separate sections 103*b* and 103*c* from section 103*a*.

Figure 15:
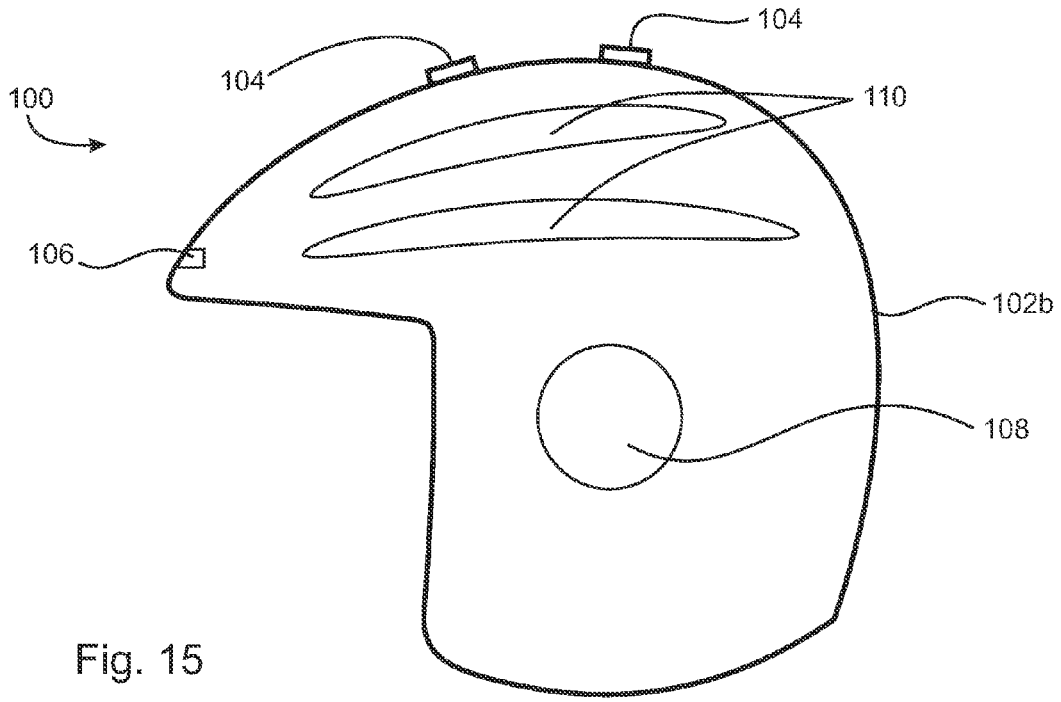
FIG. 15 is a side view of a two section embodiment of an articulating helmet including air vents.
Figure 16:
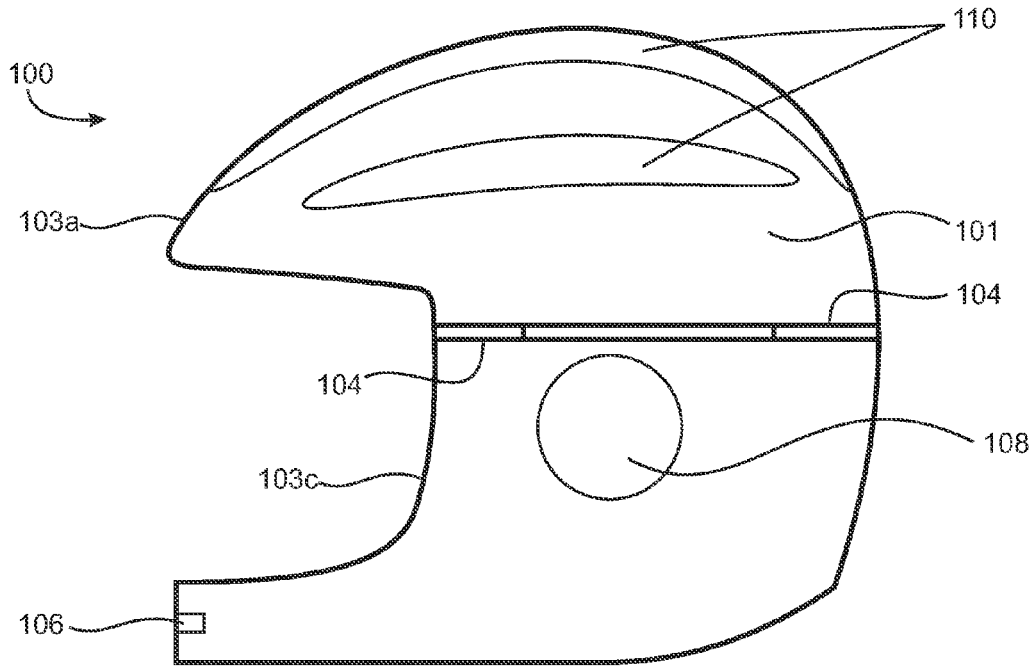
FIG. 16 is a side view of a three section embodiment of an articulating helmet showing two hinges for the articulating means.

FIG. 15 is a side view of the two section embodiment of helmet 100 with the addition of air vents 110. Also shown are two hinges 104. Similarly, FIG. 16 is a side view of the three section embodiment of helmet 100 showing two hinges 104 for section 102*c*.

Figure 17:
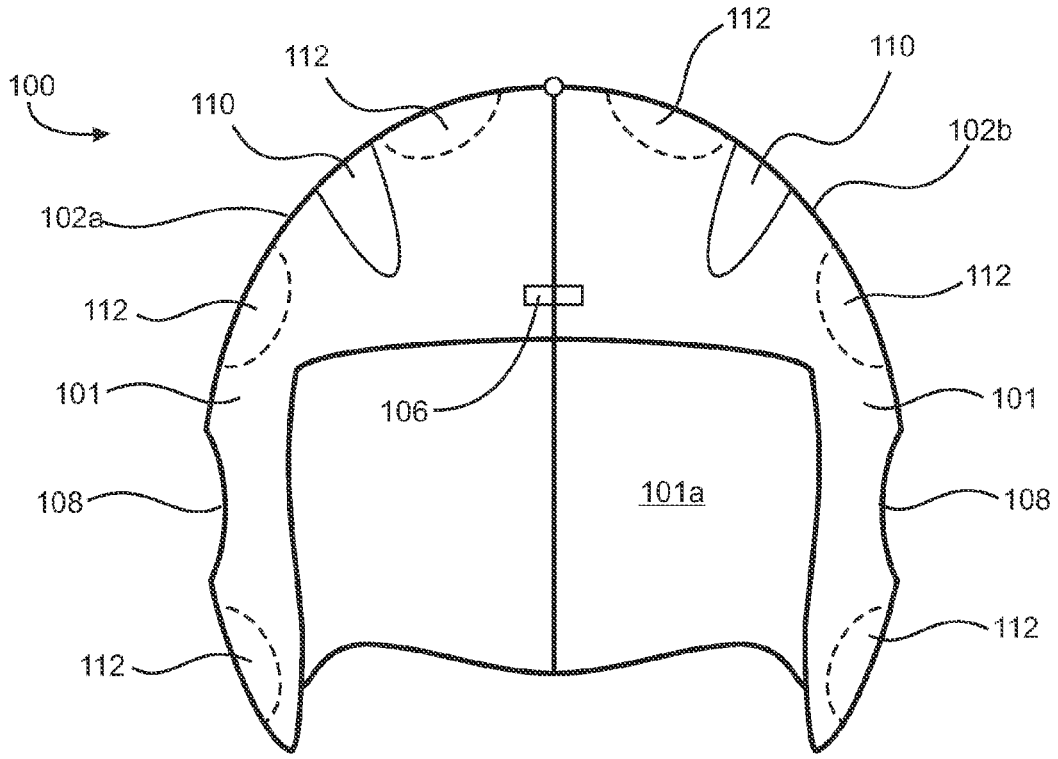
FIG. 17 is a front view of an additional alternate embodiment of an articulating helmet including pads or cushions attached to the inner surface of the helmet.

FIG. 17 is a front view of another alternate embodiment of articulating helmet 100 in which pads or cushions 112 are attached to inner surface 101*a* of helmet 100. Pads 112 may either be permanently attached to inner surface 103 (not seen in FIG. 17) with suitable attachment devices such as rivets or screws or by adhesives. Pads may be made of foam materials well known in the art.

Alternatively, pads 112 may by releasably attached to inner surface 103 using hook and loop material such as VELCRO®. This provides the advantage of enabling the user to obtain and arrange cushions 112 that provide a snug fit when helmet 110 is worn. In both embodiments, pads 112 are attached to inner surface 101*a* between vents 110 to ensure as much air as possible reaches the user.

Figure 17A:
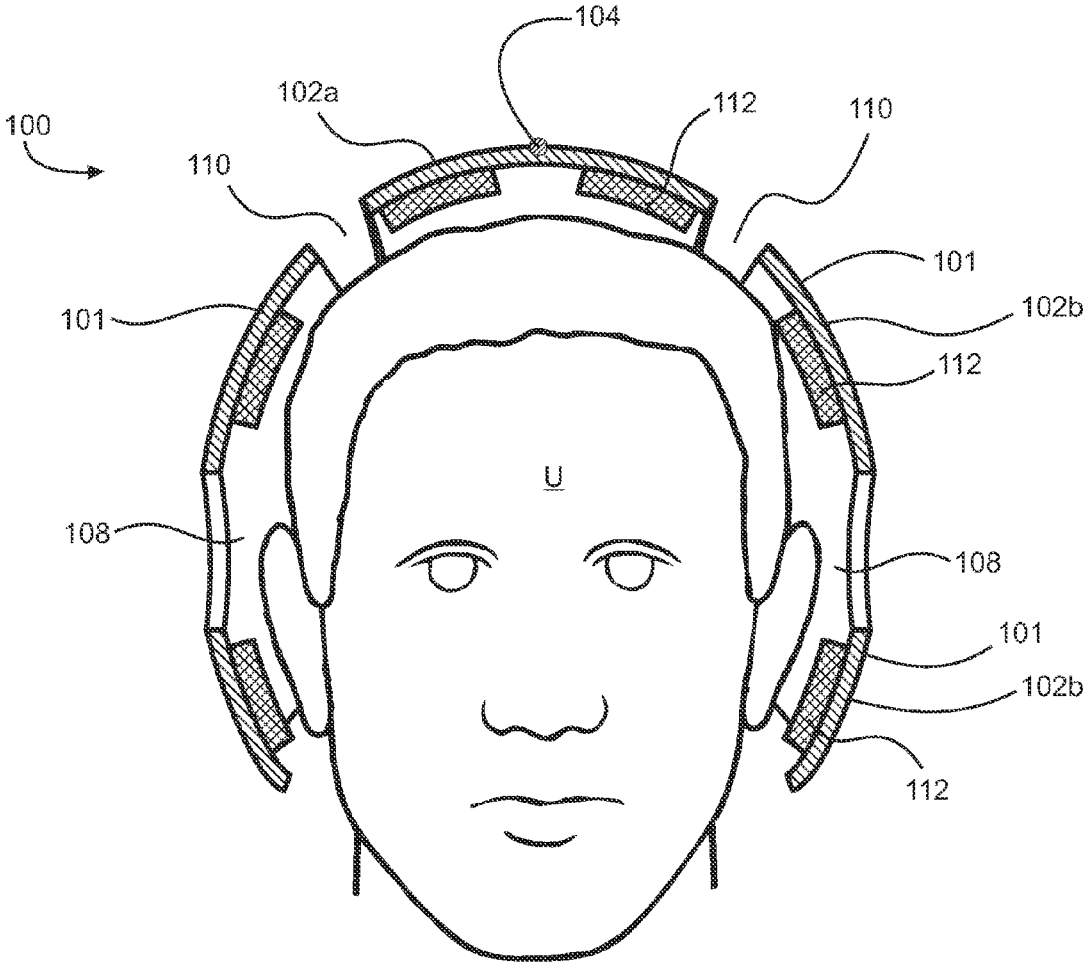
FIG. 17A is a front view of a user wearing an articulating helmet in a cross-sectional view demonstrating the fit of the helmet on the user.

FIG. 17A is a partial cross-sectional view of a user wearing articulating helmet 100. Pads 112 are contacting the top of the head of user U providing a snug fit. Note that pads 112 are attached to inner surface 101*a* in such a way as to leave air vents 110 open to provide air flow to the head. In this embodiment, ear apertures 108 are covered with a membrane or diaphragm 108*a*. In one embodiment, diaphragm 108*a* is fabricated from KEVLAR® brand fabric.

Figure 18:
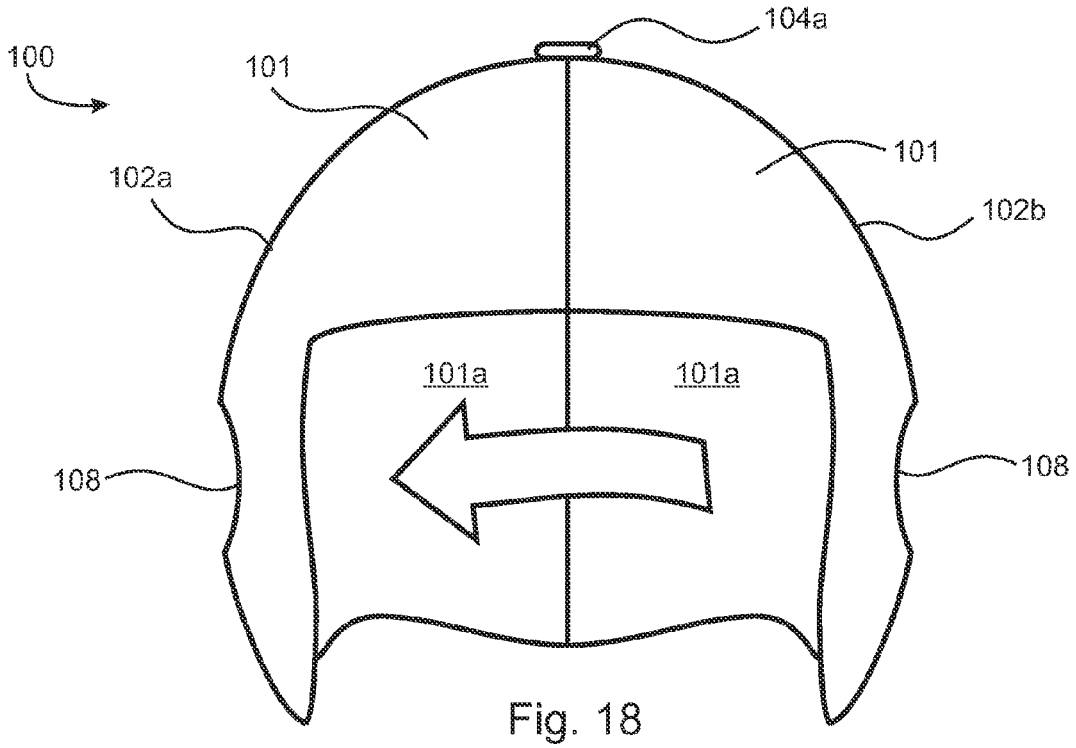
FIG. 18 is a front view of an articulating helmet.
Figure 18A:
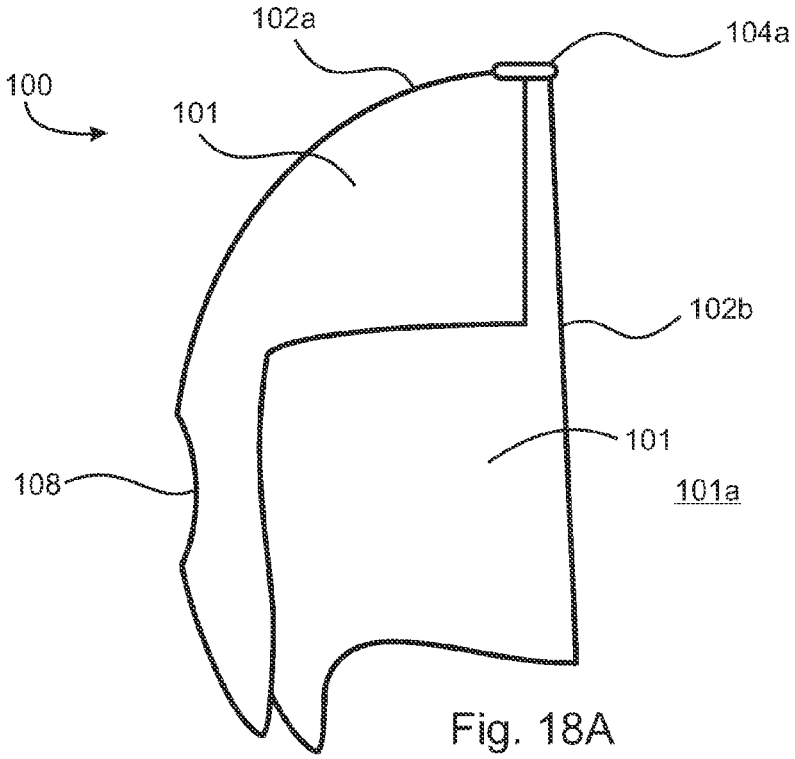
FIG. 18A is a front view of the articulating helmet of FIG. 18.

FIGS. 18 and 18A are front views of articulating helmet 100 demonstrating an embodiment in which one section of helmet 100 may nest inside the other. In FIG. 18A, section 102*b* is nested inside section 102*a*. Articulating means 104*a* is a swivel that not only holds the two sections together, but is also configured to allow sections 102*a* and 102*b* to open and to turn so that the outer surface of outer shell 101 of one section faces inner surface 101*a* of the other section. This embodiment provides the advantage of decreasing the overall volume of helmet 100 in the open position making it easier to store.

Figure 19A:
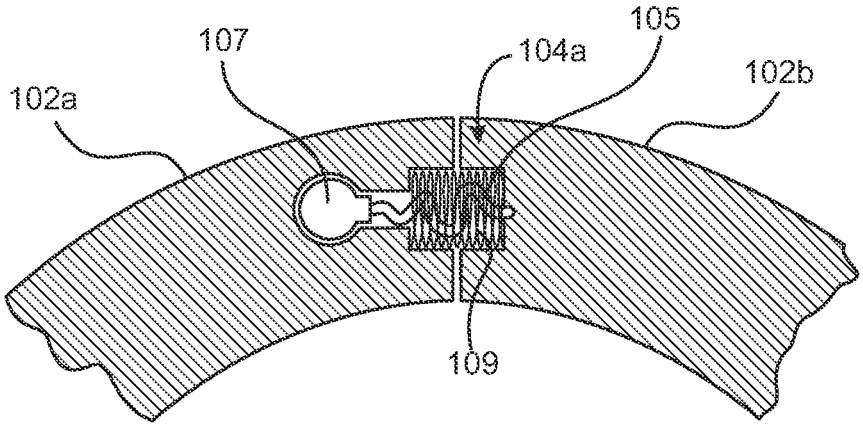
FIG. 19A depicts an enlarged cross-sectional view of a swivel that enables two articulating sections of an articulating helmet to nest within one another.
Figure 19B:
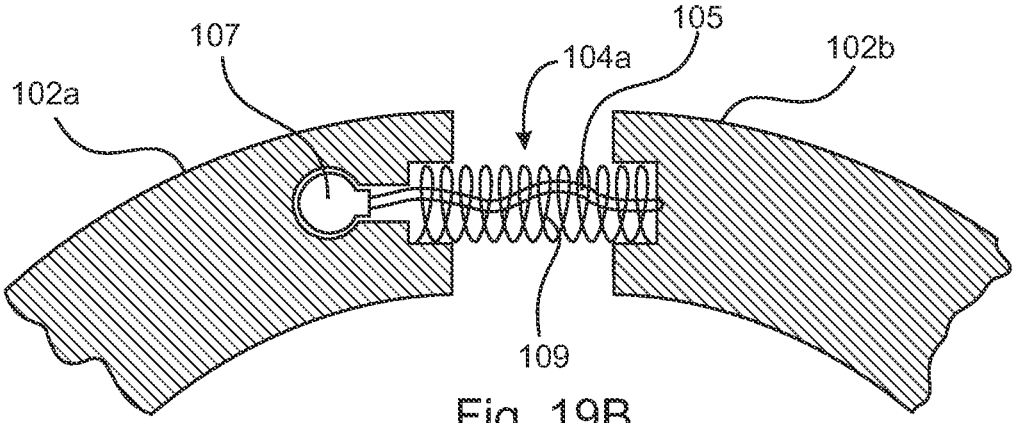
FIG. 19B depicts an enlarged cross-sectional view showing two articulating sections of an articulating helmet pulled apart prior to being placed into a nesting position; and, FIG. 19C depicts an enlarged cross-sectional view of two articulating sections in a nested position.

FIG. 19A depicts an enlarged cross-sectional view of one embodiment of swivel means 104*a* that enables sections 102*a* and 102*b* to turn and nest within one another. Cable 105 is attached to section 102*b* and universal joint 107. Universal joint 107 is attached by spring 109 to section 102*b* and is embedded in section 102*a*. Spring 109 acts to pull cable 105 plus attached section 102*b* toward section 102*a*. Universal joint 107 allows cable 105 to rotate. FIG. 19B shows the two sections 102*a* and 102*b* pulled part with stretched spring 105 holding the two sections together.

Figure 19C:
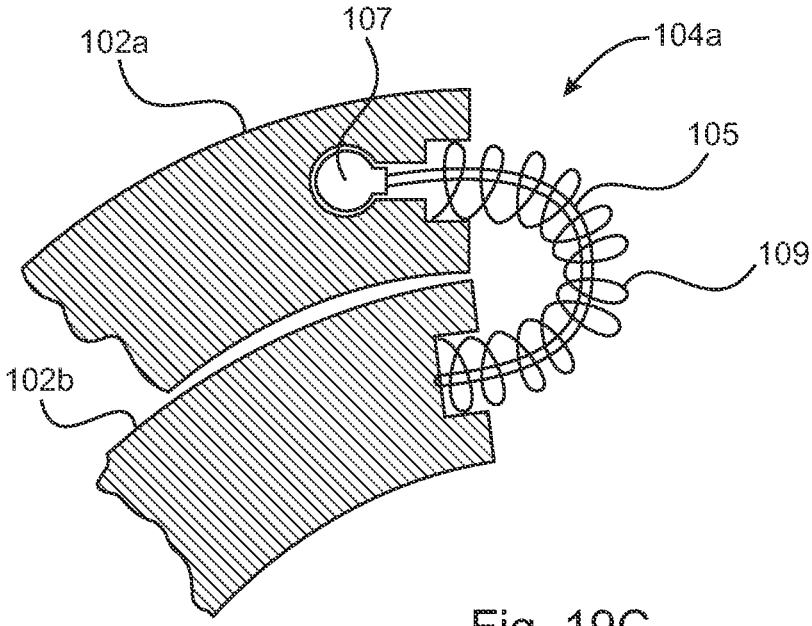

As shown in FIG. 19C, universal joint 107 enables section 102*b* to rotate relative to section 102*a* after which section 102*b* is pulled back toward section 102*a*. Because section 102*b* has been rotated, it will nest against inner surface 101*a* of section 102*a*.

In an example embodiment, protective helmet 10 is provided including hard outer shell 12 including an inner surface, hard inner shell 20 slidingly connected to the hard outer shell where the hard inner shell is spaced apart from the hard outer shell, and leaf spring 41 including a center portion anchored only at a single point 42, end 43*a*, and end 43*a* where the ends 43*a* are slidable opposite the anchored center portion. The protective helmet can also include elastomeric cord 30 extending between and connecting the hard outer shell and the hard inner shell. In an example embodiment, elastomeric cord 30 passes through intermediate shell 50 as depicted in FIGS. 7 and 8.

Thus it is seen that the objects of the invention are efficiently obtained, although changes and modifications to the invention should be readily apparent to those having ordinary skill in the art, which changes would not depart from the spirit and scope of the invention as claimed.

What is claimed is:

1. A protective helmet, comprising:

a hard outer shell including an inner surface;

a hard inner shell slidingly connected to the hard outer shell where the hard inner shell is spaced apart from the hard outer shell; and, a leaf spring comprising a center portion, a first end, and a second end, the leaf spring anchored only at the center portion onto the hard inner shell, the first end unattached to, and in direct sliding contact with the hard outer shell, and the second end unattached to, and in direct sliding contact with the hard outer shell;

wherein:

in a neutral position, the first end is spaced from said second end by a first distance; and, when a force strikes the helmet, the first end is spaced from said second end by a second distance, the second distance being different from the first distance.

2. The protective helmet as recited in claim 1, wherein the first end includes a first arm arrayed radially around the anchored center portion and the first arm is arranged to slide along the inner surface of the hard outer shell.

3. The protective helmet as recited in claim 2, wherein the second end includes a second arm arrayed radially around the anchored center portion and the second arm is arranged to slide along the inner surface of the hard outer shell.

4. The protective helmet as recited in claim 1, wherein the leaf spring is parabolic in shape.

5. The protective helmet as recited in claim 1, further comprising an elastomeric cord extending between and connecting said hard outer shell and said hard inner shell.

6. The protective helmet as recited in claim 5, wherein the elastomeric cord is uniform in thickness.

7. The protective helmet as recited in claim 5, wherein the elastomeric cord includes a thick portion and a thin portion.

8. The protective helmet as recited in claim 7, wherein the thick portion is attached to said hard inner shell.

9. The protective helmet as recited in claim 7, wherein the thin portion contacts said hard outer shell.

10. The protective helmet as recited in claim 5, wherein the elastomeric cord passes through an intermediate shell.

11. The protective helmet as recited in claim 1, further comprising viscoelastic material arranged between said hard outer shell and said hard inner shell.

12. The protective helmet as recited in claim 11, wherein said viscoelastic is made of a plurality of cone-shaped elements.

* * * * *